US006593901B1

(12) United States Patent
Kitazawa et al.

(10) Patent No.: US 6,593,901 B1
(45) Date of Patent: Jul. 15, 2003

(54) ELECTRONIC DEVICE

(75) Inventors: Isao Kitazawa, Tokyo (JP); Tomio Okigami, Higashimurayama (JP); Hiroshi Fujioka, Nakama (JP); Takashi Osa, Sayama (JP); Masahiro Sase, Fussa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/622,449

(22) PCT Filed: Dec. 14, 1999

(86) PCT No.: PCT/JP99/07011

§ 371 (c)(1),
(2), (4) Date: Oct. 3, 2000

(87) PCT Pub. No.: WO00/36582

PCT Pub. Date: Jun. 22, 2000

(30) Foreign Application Priority Data

Dec. 15, 1998 (JP) ..... 10-356121
Dec. 15, 1998 (JP) ..... 10-356122
Dec. 15, 1998 (JP) ..... 10-356123

(51) Int. Cl.[7] ..... G09G 5/00
(52) U.S. Cl. ..... 345/4; 345/40; 368/84
(58) Field of Search ..... 345/4, 33, 40, 345/903; 368/84

(56) References Cited

U.S. PATENT DOCUMENTS 4,277,786 A * 7/1981 Waldron ..... 345/53
4,449,123 A * 5/1984 Muranaga ..... 345/4
4,485,376 A * 11/1984 Noble ..... 345/4
4,508,428 A * 4/1985 Harada ..... 349/110
4,560,241 A * 12/1985 Stolov et al. ..... 349/97
5,416,494 A * 5/1995 Yokota et al. ..... 345/79
6,181,301 B1 * 1/2001 Inoguchi et al. ..... 345/5
6,292,439 B1 * 9/2001 Akiba et al. ..... 368/84

FOREIGN PATENT DOCUMENTS

| | | | |
|---|---|---|---|
| EP | 0814365 A2 | | 12/1997 |
| GB | 2062927 A | | 5/1981 |
| JP | S54-45171 | | 4/1979 |
| JP | 355146087 A | * | 11/1980 |
| JP | S57-79984 | | 5/1982 |
| JP | S57-137879 | | 8/1982 |
| JP | S57-211095 | | 12/1982 |
| JP | S61-160486 | | 10/1986 |
| JP | H2-100228 | | 8/1990 |
| JP | H3-19299 | | 2/1991 |
| JP | H9-50031 | | 2/1997 |
| WO | WO 96/11498 | | 4/1996 |

* cited by examiner

*Primary Examiner*—Steven Saras
*Assistant Examiner*—Leland R. Jorgensen
(74) *Attorney, Agent, or Firm*—Koda & Androlia

(57) ABSTRACT

An electronic device provided with a multilayer display panel (60), in which during information display by any display panel layer (1 or 2) of the multilayer display panel (60), display driving means (40) maintains all the display segments of the other display panel layer (1 or 2) to be off, allowing simple display control.

14 Claims, 23 Drawing Sheets

LOWER LAYER 2

UPPER LAYER 1

ELECTRONIC DEVICE

TECHNICAL FIELD

The present invention relates to electronic device employing a multi-layer display apparatus, in which multiple layers are combined such as liquid crystal display panel layers, and more specifically to electronic device so designed as to combine display states of the multi-layer display panel layers.

BACKGROUND ART

Electronic device has been commercialized with more functions than before, such as multifunction digital electronic watches. By featuring more functions, these products are extremely convenient for users. Products combining two layers of upper and lower digital liquid crystal display panels have also been commercialized.

The prior art will first be described with reference to FIGS. 6, 7(*a*) and 7(*b*).

FIG. 6 shows one example of a conventional multifunction digital electronic watch. The watch, which combines two layers of upper and lower digital liquid crystal display panel layers, features a calendar function, an alarm function, a world time function, and a timer function. Shown are a date display section 610, a time display section 620, and a day-of-week display section 630.

FIG. 7(*a*) shows an upper digital liquid crystal display panel layer of the multifunction digital electronic watch in which two layers of upper and lower layers of FIG. 6 are combined, time display segments 710 formed from 7-segment digit columns and AM/PM segments, and day-of-week segments (position) 720.

FIG. 7 (*b*) shows a lower digital liquid crystal display panel layer of the multifunction digital electronic watch in which two layers of upper and lower layers of FIG. 6 are combined. The digital liquid crystal panel of FIG. 6 is divided into the upper layer digital liquid crystal display panel of Fig. (a) carrying mode symbols for the alarm function, the world time function, and the timer function, and the lower layer digital liquid crystal display panel of Fig. (b) carrying the calendar function. Shown are calendar display segments 730 capable of displaying all the days of one month, month/date display segments 740 combining a month display for indicating what calendar month is shown on the calendar display segments 730 and a date display for indicating the date in a time calendar mode (to be described hereinafter), day-of-week designation segments 750 for displaying a predetermined day of week by masking the other days, a world time mode symbol segment 780, a stopwatch mode symbol segment 790, and a timer mode symbol segment 800.

In the time calendar mode shown in FIG. 6, by driving the digital liquid crystal display panel layers, in which two layers of upper and lower layers are combined, the time, date, and day-of-week are displayed as the current time of "12 o'clock, 36 minutes, and 48 seconds AM" on the 7-segment digit columns and the AM/PM segments of the time display segments 710 of FIG. 7(*a*), the date of "3" on the month/date display segments 740, the day-of-week of "Wednesday" on the day-of-week display segments 720 and the day-of-week designation segments 750.

However, because the display operations are performed by combining the upper layer and lower layer segments of the upper digital liquid crystal display panel layer shown in FIG. 7(*a*) and the lower digital liquid crystal display panel layer shown in FIG. 7(*b*), various functional mode displays, such as the time calendar mode shown in FIG. 6, are performed, and the display control operations for the multifunction digital electronic watch, in which two layers of upper and lower layers are combined, require complex control operations for turning on the upper layer and lower layer segments in combination.

Furthermore, in the upper layer digital liquid crystal display panel shown in FIG. 7(*a*) and the lower layer digital liquid crystal display panel shown in FIG. 7(*b*), the 7-segment digits and symbol segments, or only the symbol segments, are provided. Since functional information can only be displayed on the segments provided on the upper layer digital liquid crystal display panel or on the lower layer digital liquid crystal display panel even though the multifunction digital electronic watch has a combination of two layers of upper and lower layers, this configuration cannot flexibly meet the needs of the present day information-oriented society.

Furthermore, after a sudden switch to the next functional mode display during switching of various functional modes, a predetermined mode symbol is turned on among the alarm mode symbol segment 760, the alarm set symbol segment 770, the world time mode symbol segment 780, the stopwatch mode symbol segment 790, or the timer mode symbol segment 800, resulting in an uninteresting display during changes in the functional mode display.

A general TN-type liquid crystal cell has a configuration where two opposing plates of glass attached with an orientation film and a transparent electrode have the orientation of the orientation film twisted by 90 degrees, between which liquid crystal material is injected, and a polarizing plate is affixed to the outer side of each glass with the polarized light axis aligned with the orientation direction of the orientation film.

A liquid crystal molecule has a property of aligning with a plate having fine grooves in a fixed direction, namely, along the orientation direction when in contact with the orientation film. At the liquid crystal layer sandwiched between glass forming the orientation film, the orientation direction of which is shifted by 90 degrees, the liquid crystal molecule is twisted 90 degrees between the top and the bottom. Then, when light passes through the liquid crystal layer, the oscillation plane of the light bends in the direction of the liquid crystal molecule.

Furthermore, the polarizing plates affixed to the outer side of the two plates of glass of the above-mentioned liquid crystal cell use polarizing plates called absorption-type polarizing plates having a polarized light axis that allows light to be transmitted in the fixed oscillation direction and an absorption axis that causes light to be absorbed in an oscillation direction shifted by 90 degrees from the polarized light axis.

In the foregoing configuration, when external light strikes the liquid crystal cell, the light transmitted through one polarizing plate is bent and twisted 90 degrees in the direction of the liquid crystal molecules at the liquid crystal layer at the parts where no voltage is applied to the transparent electrodes provided on the inner surface of each of the two plates of glass, and is transmitted through the other polarizing plate. On the other hand, at the parts where voltage is applied to the transparent electrodes, the liquid crystal molecules align along the direction of the electric field so that the light is not affected by the influence of the liquid crystal molecules and travels straight without twisting of the oscillation plane. When the light reaches the other polarizing plate, the light cannot be transmitted and is absorbed since the polarized light axis of the polarizing plate and the oscillation direction of the light are shifted by 90 degrees.

In the liquid crystal cell of an ordinary watch, by placing a reflecting plate or a semi-transparent reflecting plate under the polarizing plate on the inner side of the watch, the incident light strikes the reflecting plate and returns so as to appear bright at the parts where the voltage of the electrodes arranged on the glass is off, and the incident light is absorbed by the polarizing plate and does not return so as to appear black at the parts where the voltage of the electrodes is on. Thus, by manipulating the voltages of the electrodes formed on the glass and from the combination of shapes of the electrodes above the liquid crystal cell, letters and numerals can be displayed.

Heretofore, besides wristwatches having watch hand displays, many watches performing time display or graphic display operations using liquid crystal cells have been commercialized. However, for watches having only one liquid crystal cell, it was impossible to display different patterns on the same liquid crystal cell display area.

This is because patterns of segments or letters were formed beforehand with transparent electrodes on the single liquid crystal cell. Although it is possible to display different patterns in the same area by using a dot-matrix display, the problem is that the spaces between dots are noticeable and it is impossible to display completely different shapes without the spaces.

Although it may be conceivable to display different patterns in the same area by further overlapping a plurality of liquid crystal cells, conventional liquid crystal cells are usually affixed with absorption-type polarizing plates and the light is attenuated even after passing through two polarizing plates for a watch with one liquid crystal cell, thereby resulting in a dark time display. Therefore, the problem is that the display becomes even darker if two liquid crystal cells are overlapped and difficult to read.

The purpose of the present invention solves the above-mentioned problems by providing electronic device with simple display control of the electronic device in which multiple layers are combined, and based on this, by providing electronic device that takes into consideration the visual effect for bright and easy to read electronic device.

DISCLOSURE OF INVENTION

In order to achieve the above-mentioned objects, in an electronic device comprising information generating means for generating information, a display apparatus, and display driving means for outputting display driving signals to the display apparatus on the basis of information from the information generating means, the display apparatus comprises a multi-layer display panel, and when information display is performed on one arbitrary display panel layer among the multi-layer display panel, the display driving means clears all segments of other display panel layers, thereby making it possible to achieve simple display control and effective use of the panel display.

The information generating means comprises reference signal generating means, and means for generating information, such as time information on the basis of the reference signal from the reference signal generating means, the display apparatus comprises a multi-layer display panel, with all or part of at least one layer of the multi-layer display panel having a dot-matrix format, and the display driving means comprises a dot-matrix controller for controlling the display of a dot-matrix display panel to handle a variety of functional mode displays.

If state transition controlling means is provided for performing control of the display transitions of the display apparatus, it is possible to add variations so as to emphasize the transition display for the user.

If the above-mentioned display apparatus is configured so as to comprise a multi-layer liquid crystal display panel in which liquid crystal display cells are arranged in multiple layers, display can be varied and the power consumption can be reduced.

If a reflecting-type polarizing plate is used for at least one liquid crystal display cell of the above-mentioned display apparatus, it is possible to realize a brighter display having richer variations.

If the above-mentioned display apparatus is a multi-layer liquid crystal display panel in which a plurality of liquid crystal display cells are arranged so as to overlap and the lowest layer liquid crystal cell comprises a reflecting-type polarizing plate that opposes a backface member, it is possible to realize a brighter display having richer variations.

If the above-mentioned display apparatus is provided with a plurality of liquid crystal display cells arranged so as to overlap, and a light diffusion layer between the above-mentioned backface member arranged on the lowest layer side of the multi-layer liquid crystal display panel and the above-mentioned lowest layer liquid crystal display cell, it is possible to realize a bright and consistent display.

If at least one polarizing plate, besides the reflecting-type polarizing plate of the lowest layer liquid crystal display cell, is a reflecting-type polarizing plate, the application of the reflecting-type polarizing plate can result in a brighter display.

If the above-mentioned liquid crystal display panel comprises two layers of liquid crystal cells, and three polarizing plates of which the uppermost layer polarizing plate is an absorption-type polarizing plate and the middle layer polarizing plate is a reflecting-type polarizing plate, it is possible to realize a display rich in variations.

If the surface of the above-mentioned backface member is colored, it is possible to have a display rich in variations.

If the above-mentioned backface member is a reflecting plate or an EL plate, a bright display can be achieved.

If the above-mentioned multi-layer display panel has a quadrilateral display screen, of which only the central area is a dot-matrix format display, variety can be added to the display.

If the above-mentioned middle layer reflecting-type polarizing plate is affixed to an upper layer liquid crystal cell and separated from a lower layer liquid crystal cell, the polarizing plate can serve a dual purpose.

If the display of the above-mentioned liquid crystal panel is set to a reflecting state when no voltage is applied to the above-mentioned upper layer liquid crystal cell, an appearance rich in variations can be obtained.

If the display of the above-mentioned liquid crystal panel is set to a reflecting state when a voltage is applied to the above-mentioned upper layer liquid crystal cell, an appearance rich in variations can be obtained.

MODE(S) FOR CARRYING OUT THE INVENTION

Figure 1:
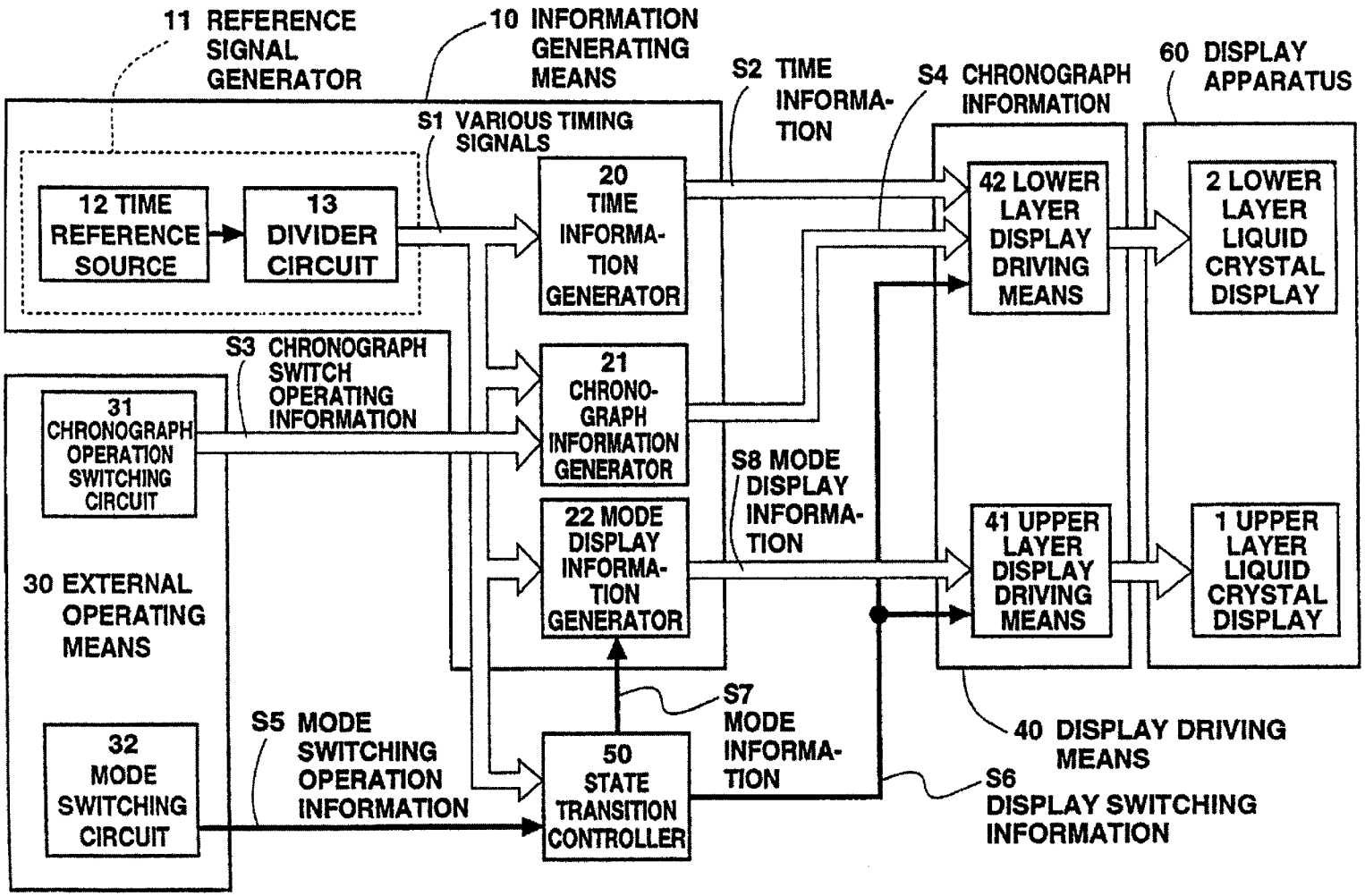
FIG. 1 is a system block diagram of a first embodiment of the present invention.

Embodiments of the present invention will be described hereinafter with reference to the attached drawings. FIG. 1 is a block diagram of an upper and lower two-layer liquid crystal display apparatus, which is a first embodiment of the present invention. The system configuration of this embodiment comprises information generating means 10, external operating means 30, display driving means 40, a state transition controller 50, and a display apparatus formed from an upper layer liquid crystal display 1 and a lower layer liquid crystal display 2.

The external operating means 30 comprises a chronograph operation switching circuit 31 and a mode switching circuit 32, each respectively outputting chronograph switch operating information 53 and mode switching operation information S5. The display driving means 40 comprises upper layer display driving means 41 for driving the upper layer liquid crystal display 1 and lower layer display driving means 42 for driving the lower layer liquid crystal display 2.

The information generating means 10 comprises a reference signal generator 11, a time information generator 20, a chronograph information generator 21, and a mode display information generator 22. The reference signal generator 11 comprises a time reference source 12 and a divider circuit 13 where the time reference source 12 creates a reference signal for time measurement, and the divider circuit 13 divides the reference signal from the time reference source 12 and creates various timing signals S1 required in the information generating means 10.

The time information generator 20 receives the various timing signals S1 from the reference signal generator 11 to perform time measurement operations, and outputs time information S2 to the lower layer display driving means 42. The chronograph information generator 21 receives various timing signals S1 from the reference signal generator 11 and chronograph switch operating information S3 from the chronograph operation switching circuit 31 to perform chronograph measurement operations, and outputs chronograph information S4 to the lower layer display driving means 42. The lower layer display driving means 42 receives the time information S2 and chronograph information S4 to drive the lower layer liquid crystal display 2.

The state transition controller 50 receives mode switching operation information S5 from the mode switching circuit 32 and various timing signals S1 from the reference signal generator 11, and outputs mode information S7 to the mode display information generator 22. The mode display information generator 22 receives mode information S7 and outputs mode display information S8 to the upper layer display driving means 41. The upper layer display driving means 41 receives mode display information S8 to drive the upper layer liquid crystal display 1.

Simultaneously, the state transition controller 50 outputs display switching information S6 to the upper layer display driving means 41 and the lower layer display driving means 42 and controls the display during mode switching.

Figure 2:
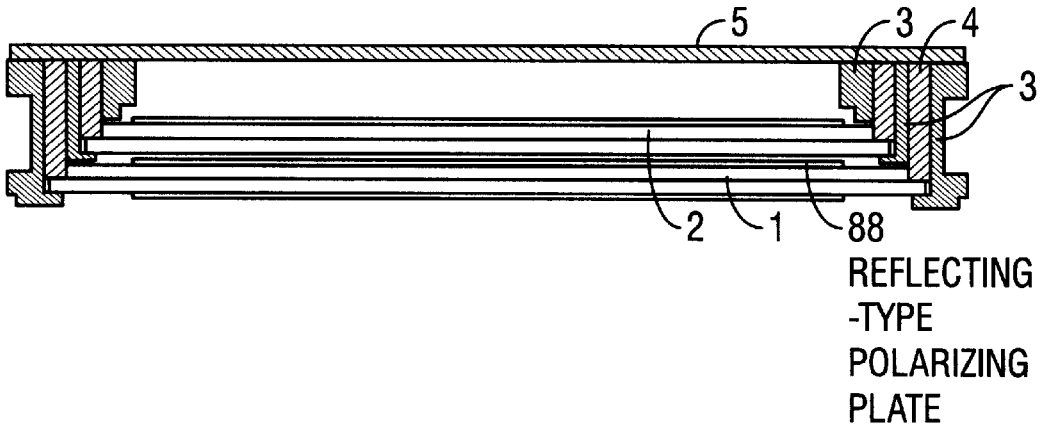
FIG. 2 is a cross-sectional view of an upper and lower two-layer liquid crystal display apparatus in the first embodiment of the present invention.

Next, the configuration of the display apparatus of the first embodiment of the present invention will be described. FIG. 2 is a cross-sectional view of the upper and lower two-layer liquid crystal display apparatus according to the present invention. The upper layer liquid crystal display (panel) 1 and the lower layer liquid crystal display (panel) 2 are laminated and supported by a cell support frame 3. The system shown in FIG. 1, except for the upper layer liquid crystal display 1 and the lower layer liquid crystal display 2, is built onto a circuit board 5. The circuit board 5 is electrically connected to the upper layer liquid crystal display 1 and to the lower layer liquid crystal display 2 by conducting means 4. A reflecting-type polarizing plate 88 is arranged between the upper layer liquid crystal display 1 and the lower layer liquid crystal display 2 and serves a dual purpose as an upper-side polarizing plate of the lower layer liquid crystal display 2 and a lower-side polarizing plate of the upper layer liquid crystal display 1.

Figure 3A:
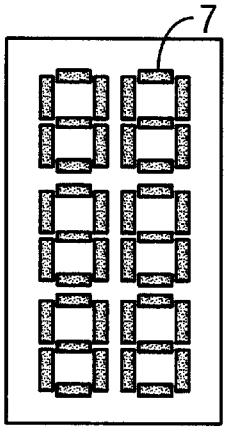
FIGS. 3(*a*) and 3(*b*) are top views illustrating segments of the upper and lower two-layer liquid crystal display apparatus, respectively showing the segments of the lower layer liquid crystal display and the upper layer liquid crystal display.
Figure 3B:
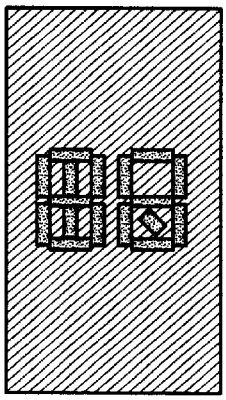

FIG. 3(*a*) is a top view of the lower layer liquid crystal display 2 of the upper and lower two-layer liquid crystal display apparatus according to the present invention and FIG. 3(*b*) is a top view of the upper layer liquid crystal display 1 of the upper and lower two-layer liquid crystal display apparatus according to the present invention. Digits for representing the mode are configured at the center of the upper layer liquid crystal display 1, and the part besides these digits is in itself an integrated segment.

The upper layer liquid crystal display 1 is affixed with an absorption-type polarizing plate to the upper surface and a reflecting-type polarizing plate to the lower surface. When the polarized light axes of both polarizing plates are parallel to each other, light is transmitted until it reaches the lower layer liquid crystal display 2. This is considered the ON state. In contrast, when the polarized light axes of both polarizing plates are perpendicular to each other, light is reflected and does not reach the lower layer liquid crystal display 2, and appears similar to a mirror. This is considered the OFF state.

On the upper layer liquid crystal display 1 are configured six 7-segment digits 7 for displaying information of time, chronograph, and so forth. These digits employ the well-known TN liquid crystal display. However, since the lower-side polarizing plate is colored, the non-segment part and the segments that are off appear to have the color of the polarizing plate. It should be noted that the upper-side polarizing plate of the lower layer liquid crystal display 2 also serves as the lower-side polarizing plate of the upper layer liquid crystal display 1 and adjusts the light axes between both liquid crystal displays. This dual-purpose polarizing plate preferably employs the reflecting-type polarizing plate 88.

The upper and lower two-layer liquid crystal display apparatus according to the present invention has a number of states resulting from the display states of the upper layer liquid crystal display 1 and the lower layer liquid crystal display 2. These states are summarized in Table 1. In state 1 of Table 1, the upper layer liquid crystal display 1 is completely in the OFF state. This state is called the shutter state since the lower layer liquid crystal display 2 cannot be seen as it a shutter had been closed, or called a mirror state since the upper layer liquid crystal display 1 reflects light like a mirror. At this time, since the lower layer liquid crystal display 2 cannot be seen, it is turned off completely to conserve power.

TABLE 1

| | Upper Layer Liquid Crystal Display 1 | Lower Layer Liquid Crystal Display 2 |
|---|---|---|
| State 1 | Shutter (mirror) state | All OFF (color of polarizing plate) |
| State 2 | Information display state | All OFF (color of polarizing plate) |
| State 3 | Complete transmission state | Information display state |

Several display states will further be described hereinafter with reference to Table 1.

In state 2, information displays of various types are performed by the upper layer liquid crystal display 1. In this state, the upper layer liquid crystal display 1 has ON segments and OFF segments. Since the lower layer liquid crystal display 2 can be seen at the ON segments, the lower layer liquid crystal display 2 is turned off to improve the appearance. Namely, a control operation to display information on the upper layer liquid crystal display 1 and a control operation to turn off all the segments of the lower layer liquid crystal display 2 are performed in combination in the state transition controller 50 of FIG. 1, and the display is driven with the display driving signals from the display driving means 40, thereby displaying the display information in the color of the polarizing plate of the lower layer liquid crystal display 2 at the ON segments of the upper layer liquid crystal display 1.

In state 3, the upper layer liquid crystal display 1 is completely in the ON state so as to transmit light, and information displays of various types are performed by the lower layer liquid crystal display 2. Namely, information display on the lower layer liquid crystal display 2 and a control operation to turn off all the segments of the upper layer liquid crystal display 1 are performed in combination in the state transition controller 50 of FIG. 1, and the display is driven with the display driving signals from the display driving means 40, thereby causing a normal liquid crystal display of a watch to appear on the lower layer liquid crystal display 2.

Figures 4A, 4B, 4C:
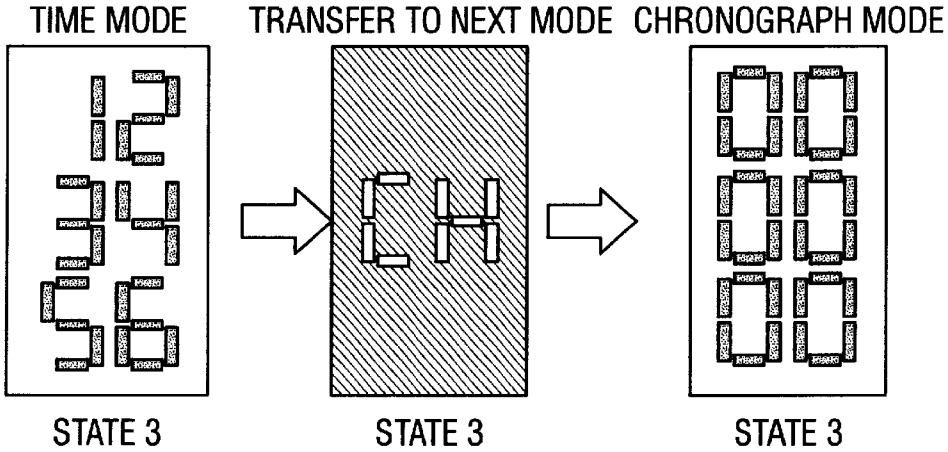
FIGS. 4(*a*) to 4(*c*) are transition diagrams showing the transition of display in the first embodiment according to the present invention.

Actual display transitions will be described hereinafter with reference to FIGS. 4(*a*)–4(*c*). FIGS. 4(*a*)–4(*c*) give transition diagrams showing the display transitions when mode switching in the present embodiment is performed from the time mode to the chronograph mode. The time mode has the display state of the above-mentioned state 3 in which the upper layer liquid crystal display 1 is completely in the OFF state so as to transmit light, and the lower layer liquid crystal display 2 displays the time data S2 (FIG. 4(*a*)).

When mode switching is performed from this state, the mode switching operation information S5 is output to the state transition controller 50 from the mode switching circuit 32. The state transition controller 50 receives the mode switching operation information S5 and outputs display switching information S6 to the upper layer display driving means 41 and the lower layer display driving means 42.

The upper layer display driving meam 41 receives the display switching information S6 and turns on the digits "CH" signifying chronograph on the upper layer liquid crystal display 1 and turns off the other segments. The lower layer display driving means 42 receives the display switching information S6 and completely turns off the lower layer liquid crystal display 2. State 2 is a combination of both displays in which "CH" is displayed in the color of the color polarizing plate in the minor display. As a result, it is possible to strongly emphasize to the user the transition to the chronograph mode, that is, the contents of the next display state. This "CH" display, that is, guide display, continues for a period of time (FIG. 4(*b*)).

After "CH" is displayed for a period of time, the upper layer display driving means 41 again completely turns off the upper layer liquid crystal display 1 to set the complete transmission state. The lower layer display driving means 42 displays the chronograph information on the lower layer liquid crystal display 2. State 3 is a combination of both displays in which mode contents are displayed in a manner similar to the normal watch display (FIG. 4(*c*)).

The foregoing described the first embodiment according to the present invention. In this embodiment, the time mode and chronograph mode are displayed in state 3, and the mode display in state 2 during mode transition emphasizes the mode transition. However, the display function of the present invention cannot be said to be fully utilized since state 1 is not used. A second embodiment providing further visual impact for mode transitions incorporates state 1 and will be described with reference to FIGS. 5(*a*)–5(*e*). The system configuration is identical to that shown in FIG. 1 so its description will be omitted.

Figures 5A, 5B, 5C, 5D, 5E:
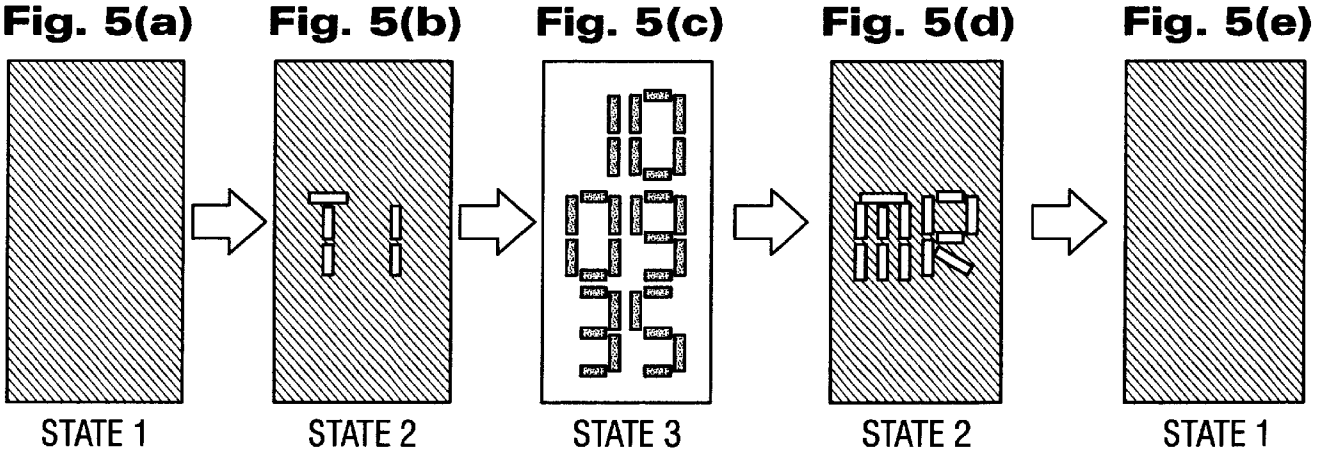
FIGS. 5(*a*) to 5(*e*) are transition diagrams showing the transition of display in the second embodiment according to the present invention.
Figure 6:
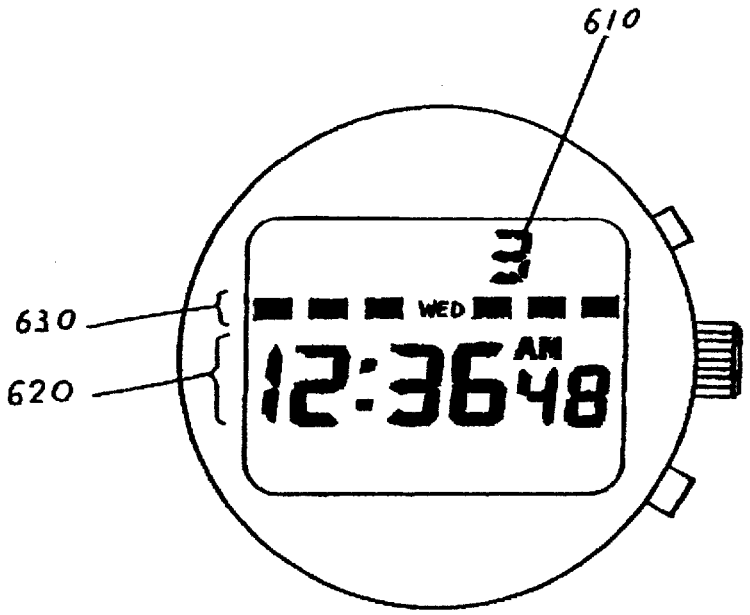
Fig. 6 PRIOR ART
FIG. 6 is a top view showing the information display state of electronic device according to the prior art.
Figure 7A:
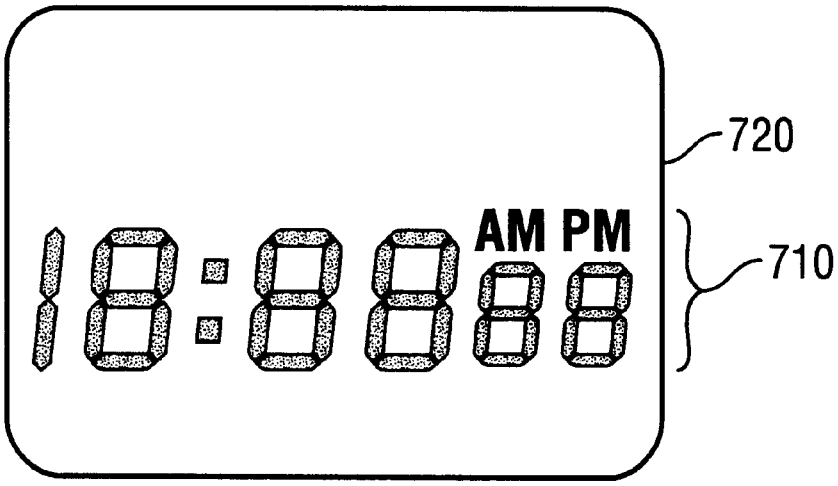
Fig. 7(a) PRIOR ART
FIGS. 7(*a*) and 7(*b*) are top views showing the respective segments the upper layer liquid crystal display and the lower layer liquid crystal display.
Figure 7B:
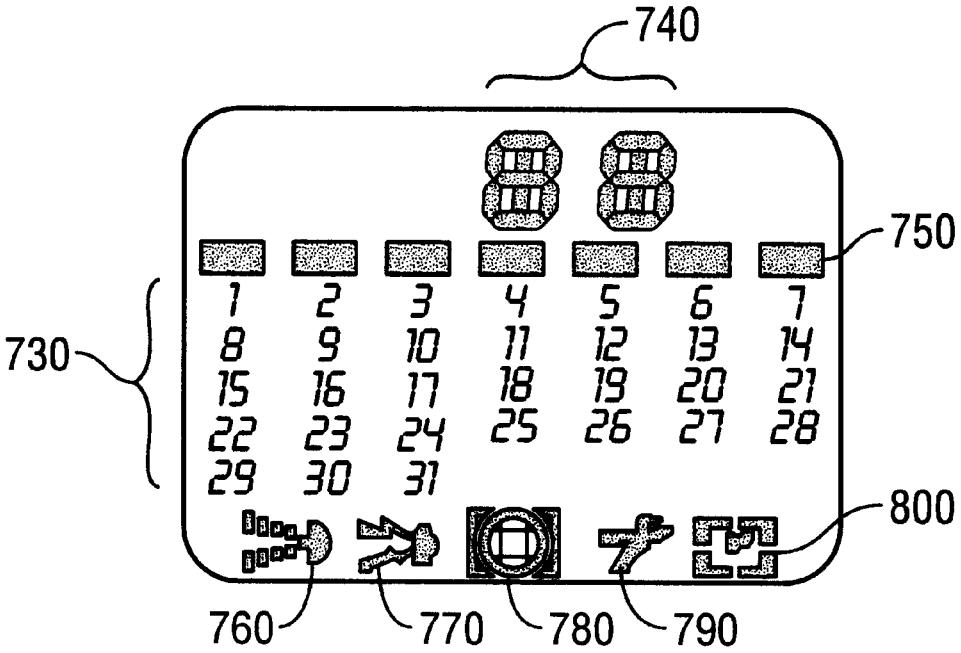
Fig. 7(b) PRIOR ART

FIGS. 5 (*a*)–5(*e*) give transition diagrams showing the display transitions in the second embodiment according to the present invention. This embodiment has a mirror display state that does not belong to either the time mode or chronograph mode. All mode transitions are performed via the mirror display state. The transition diagrams of FIGS. 5(*a*)–5(*e*) show a case where the mirror display state transfers to the time mode and thereafter again transfers back to the mirror display state.

Hereinafter, the transition diagrams showing the display transitions of the second embodiment according to the present invention of FIGS. 5(*a*)–5(*e*) will be described with reference to Table 1.

First is the mirror display state of state 1 (FIG. 5 (*a*)). In this state, the upper layer liquid crystal display 1 is in the mirror state and the user does not obtain information. However, state 1 is highly effective since there is a power saving effect due to the all OFF state, and moreover the mirror display itself is one type of visual effect.

When mode switching is performed from the display state (a), the mode switching circuit 32 outputs the mode switching operation information S5 to the state transition controller 50. The state transition controller 50 receives the mode switching operation information S5 and outputs the display switching information S6 to the upper layer display driving means 41 and the lower layer display driving means 42 or transition to state 2. This is identical to the first embodiment except that the "TI" characters, that is, guidance display, are displayed to indicate the time mode, that is, the contents of the next display state (FIG. 5(*b*)), Furthermore, after a period of time has elapsed from (b), the state transfers to state 3, which shows the contents of the time mode (FIG. 5(*c*)). When the mode switching operation is cup performed from (c), the state transfers to the mirror display state. At this time, the state first transfers to state 2 (FIG. 5(*d*)) in which the characters "MR", that is, guidance display, are displayed to indicate the mirror display state, that is, the contents of the next display state, and after the display of a period of time, the state again transfers back to the mirror display state of state 1 (FIG. 5(*e*)).

Although liquid crystal display panels based on heretofore mainstream segments, such as 7-segment displays, are used for both the upper and lower two-layer liquid crystal display panels in the first and second embodiments, at least one of the layers may also be of the dot-matrix format.

As described in the foregoing, for the display control operations of the multifunction digital electronic watch combining the upper and lower two layers, the two layers of upper and lower layer liquid crystal display panels can be effectively used through simple control operations by configuring them so that information display is performed by the segments of either the upper layer or the lower layer, and all the segments of the liquid crystal display panel of the other layer are completely turned off.

Furthermore, during the switching of the various functional modes, the mode contents of the next functional mode are displayed prior to the transition to the next functional mode display. This makes it easy for the user to visually understand the electronic device (multifunction digital electronic watch) provided with the upper layer digital liquid crystal display panel and the lower layer digital liquid crystal display panel, and makes it possible to achieve simple control operations during display switching as well as to realize electronic device visually meeting the needs of users as a tool of the present day information-oriented society.

Figure 8:
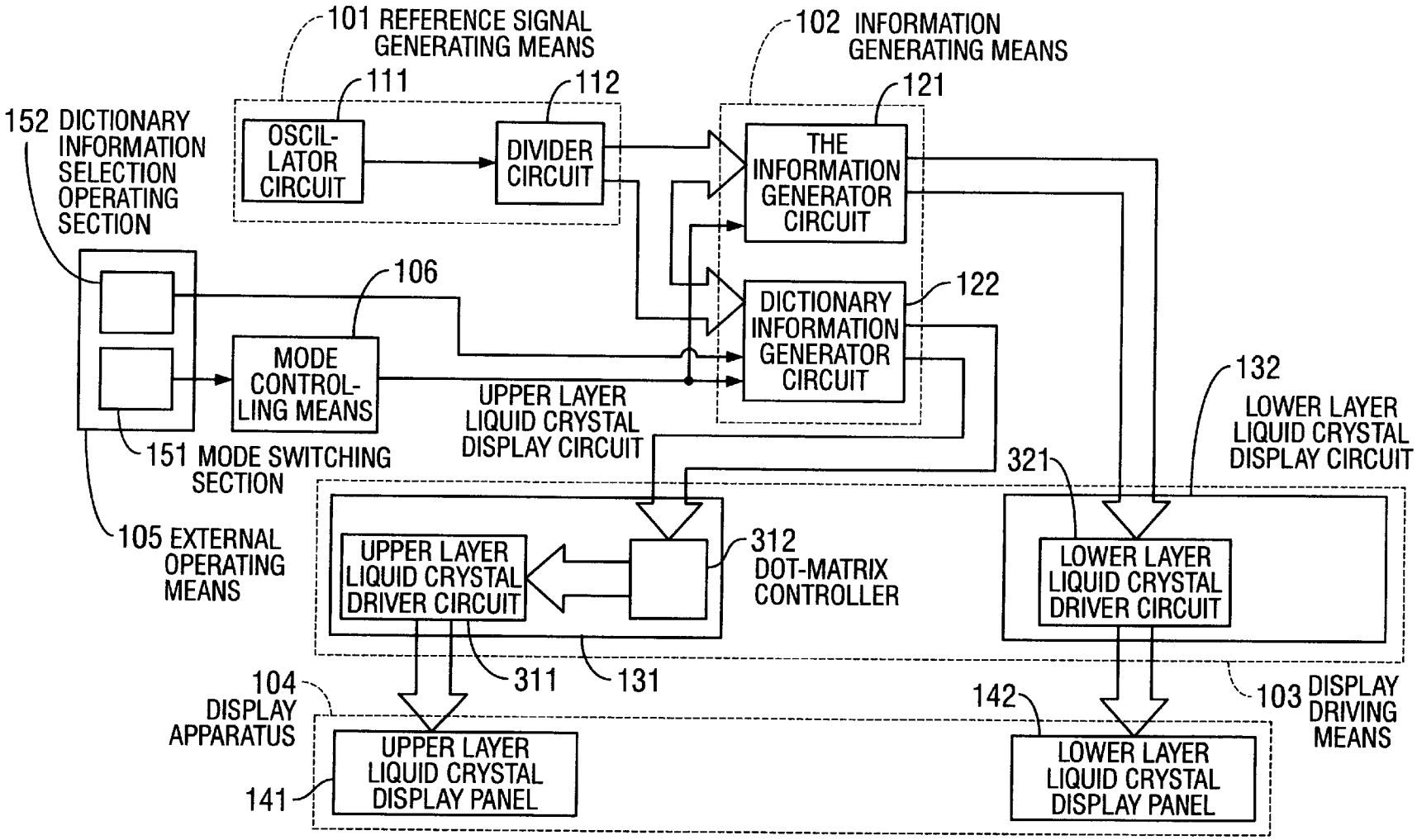
FIG. 8 is a block diagram showing the circuit configuration of a multifunction digital electronic watch of the third embodiment according to the present invention.
Figure 9A:
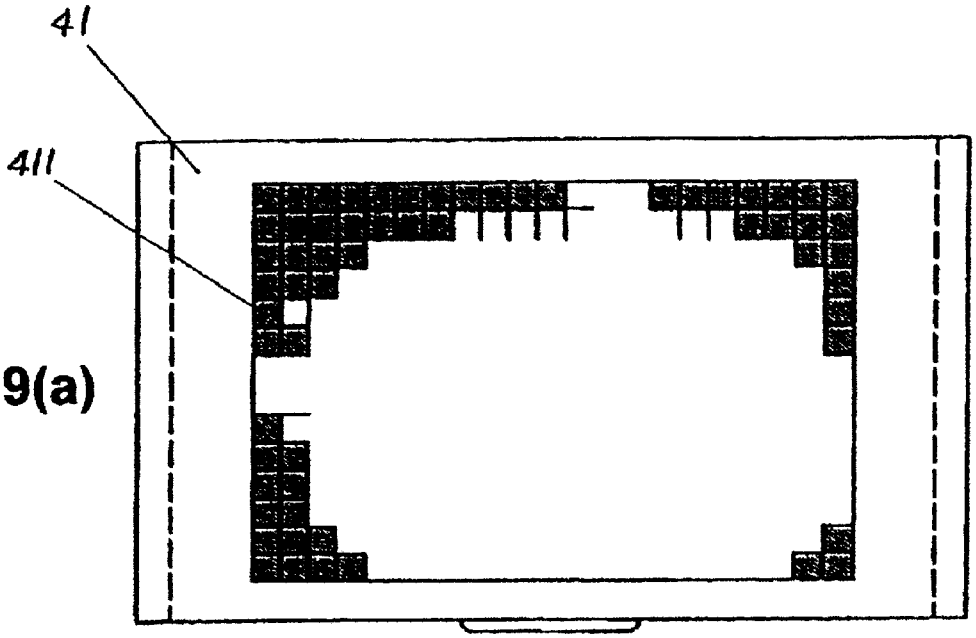
FIGS. 9(*a*) and 9(*b*) are top views showing the respective segments of the upper layer liquid crystal display panel (layer) and the lower layer liquid crystal display panel (layer) of the display apparatus in FIG. 8.
Figure 9B:
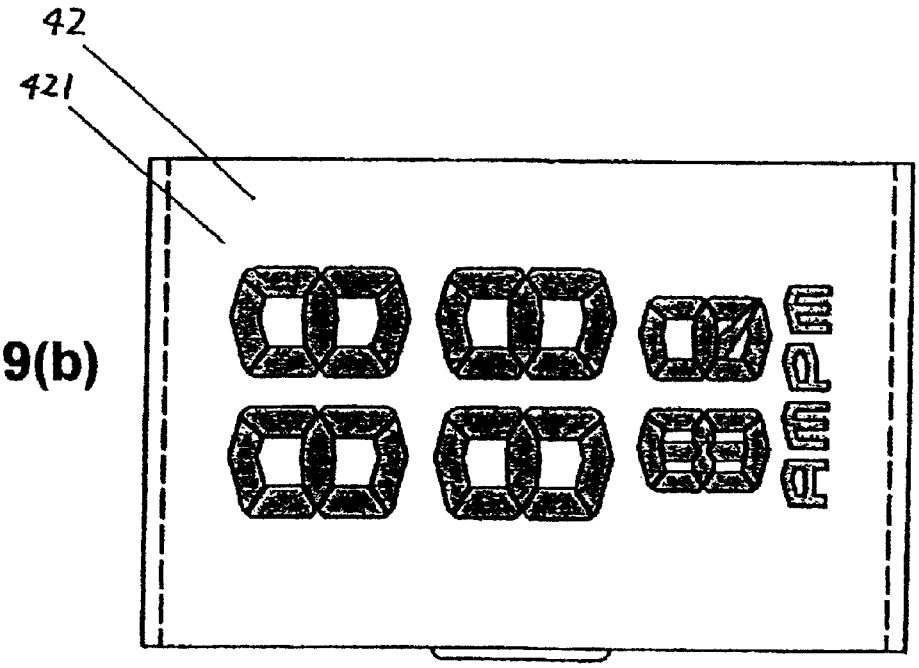

Next, the multifunction digital electronic watch of a third embodiment according to the present invention will be described with reference to FIGS. 8, 9(*a*),9(*b*), 10(*a*) and 10(*b*). FIG. 8 is a circuit block diagram, FIGS. 9(*a*) and 9(*b*) are respectively top views of segments of the upper layer and lower layer liquid crystal display panels, FIGS. 10 (*a*) and 10(*b*) are respectively top views showing the information display states on the upper layer and lower layer liquid crystal display panels. First, the circuit block diagram of FIG. 1 will be described. In FIG. 8, an oscillator circuit 111 supplies a 32768 Hz signal to a divider circuit 112, the divider circuit 112 is formed from a plurality of stages of dividers and supplies a divided signal group to information generating means 102, the information generating means 102 supplies predetermined information to display driving means 103 under control of various control signals from external operating means 105 and mode controlling means 106 in addition to the divided signal group, the display driving means 103 boosts and creates a voltage required for driving the liquid crystal display segments, and information display is performed on a display apparatus 104 by predetermined display driving signals.

Reference signal generating means 101 comprises an oscillator circuit 111, and a divider circuit 112 for inputting and dividing an oscillating signal. The information generating means 102 comprises a time information generator 121 and a dictionary information generator 122. The display driving means 103 is internally provided with a booster circuit (not shown) and comprises an upper layer liquid crystal display circuit 131 further comprising an upper layer liquid crystal driver circuit 311 and a dot-matrix controller 312 for controlling the drive of the dot display, and a lower layer liquid crystal display circuit 132 further comprising a lower layer liquid crystal driver 321. The display apparatus 104 comprises an upper layer liquid crystal display panel (layer) 141 and a lower layer liquid crystal display panel (layer) 142. The external operating means 105 comprises a mode switching section 151 for performing switching control of the time function mode and the dictionary function mode, and a dictionary information selection operating section 152 for performing operations to select a desired word from the dictionary information.

Next, the operation of the third embodiment will be described.

Figure 10A:
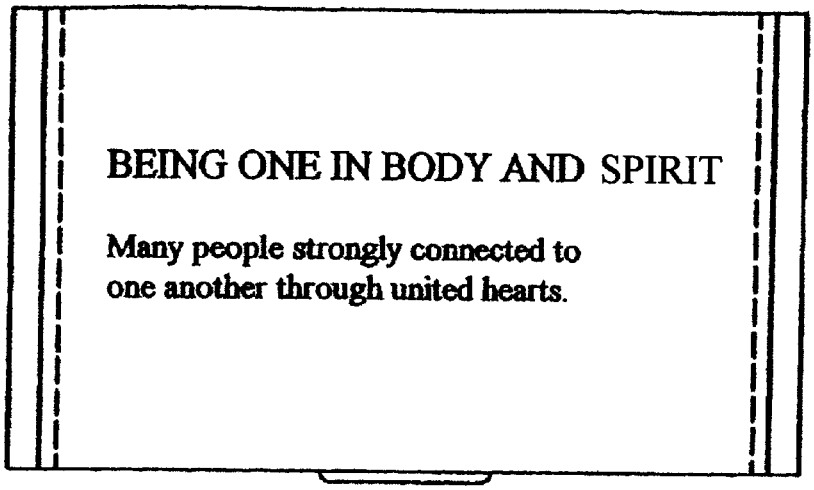
FIGS. 10(*a*) and 10(*b*) are top views respectively showing the information display states of the display apparatus in FIG. 8 for the upper layer liquid crystal display panel and for the lower layer liquid crystal display panel.
Figure 10B:
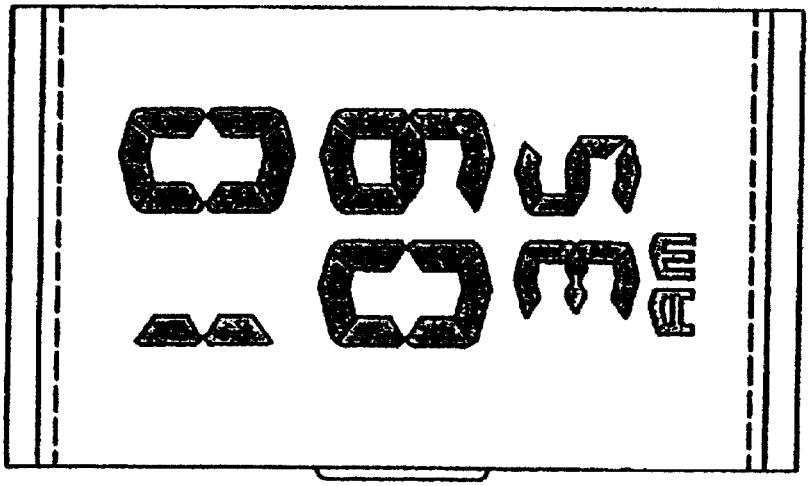

The display operation of the multifunction digital electronic watch, which is the electronic device according to the present invention of FIG. 1, will be described with reference to FIGS. 9(*a*), 9(*b*), 10(*a*) and 10(*b*). FIGS. 10(*a*) and 10(*b*) represent the superimposed state of the upper layer liquid crystal display panel 141 (64 dots vertical×256 dots horizontal) of FIG. 9 (*a*) and the lower layer liquid crystal display panel 142 of FIG. 9(*b*). The information generating means 102 outputs only the information from the dictionary information generator 122 based on control of the mode switching section 151 of FIG. 8, and the relevant information is input by the dot-matrix controller 312 and passes the upper layer liquid crystal driver circuit 311 to drive the upper layer liquid crystal display panel 141 for display operations. As a result, FIG. 10(*a*) shows a state where the dictionary information "*" that was selected and displayed on the basis of the dictionary information selection operating section 152 of FIG. 8 is displayed on segments 411 of the dot-matrix format of FIG. 9 (*a*) and segments 421 of the 7-segment format of FIG. 9(*b*) are not displayed (all segments in OFF state). Conversely, the information generating means 102 outputs only the information from the time information generator circuit 121 based on control of the mode switching section 151, and the relevant information passes the above-mentioned lower layer liquid crystal driver circuit 321 to drive the lower layer liquid crystal display panel 142 for display operations. As a result, FIG. 10(*b*) shows a time display state where the segments 411 of the dot-matrix format of FIG. 9(*a*) are not displayed (all segments in OFF state) and segments 421 of the 7-segment format of FIG. 9(*b*) are displayed.

Figure 11:
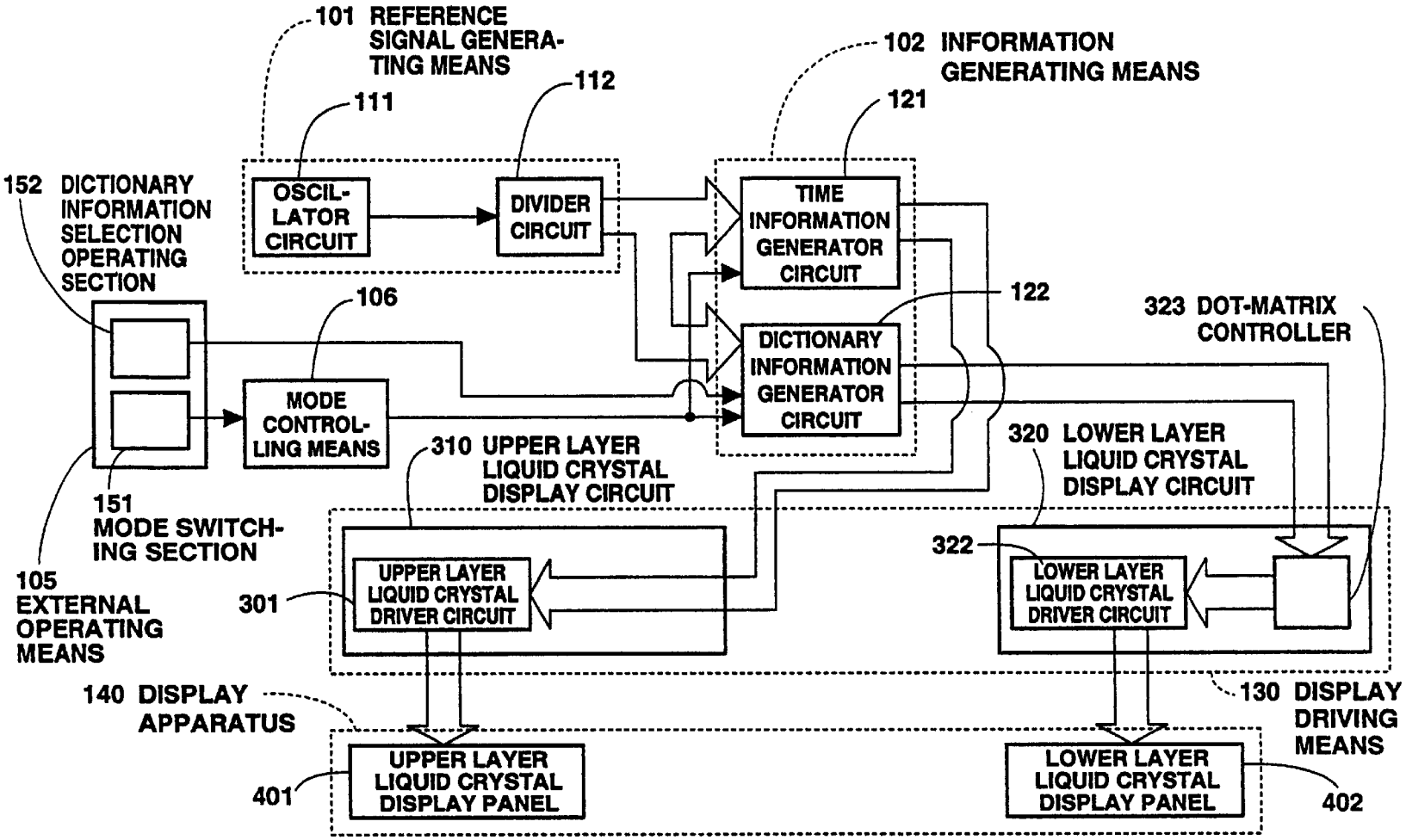
FIG. 11 is a block diagram showing the circuit configuration of a multifunction digital electronic watch of the fourth embodiment according to the present invention.

Next, the multifunction digital electronic watch of a fourth embodiment according to the present invention based on the circuit block diagram of FIG. 11 will be described. In FIG. 11, components that are identical to those in the circuit block diagram of the third embodiment of FIG. 8 are given the same reference numerals and their descriptions will be omitted.

In FIG. 11, display driving means 130 comprises an upper layer liquid crystal display circuit 310 further comprising an upper layer liquid crystal driver circuit 301, and a lower layer liquid crystal display circuit 320 further comprising a lower layer liquid crystal driver circuit 322 and a dot-matrix controller 323 for performing driving control of the dot display. A display apparatus 140 comprises an upper layer liquid crystal display panel 401 and a lower layer liquid crystal display panel 402, which is a dot-matrix display.

Figure 12A:
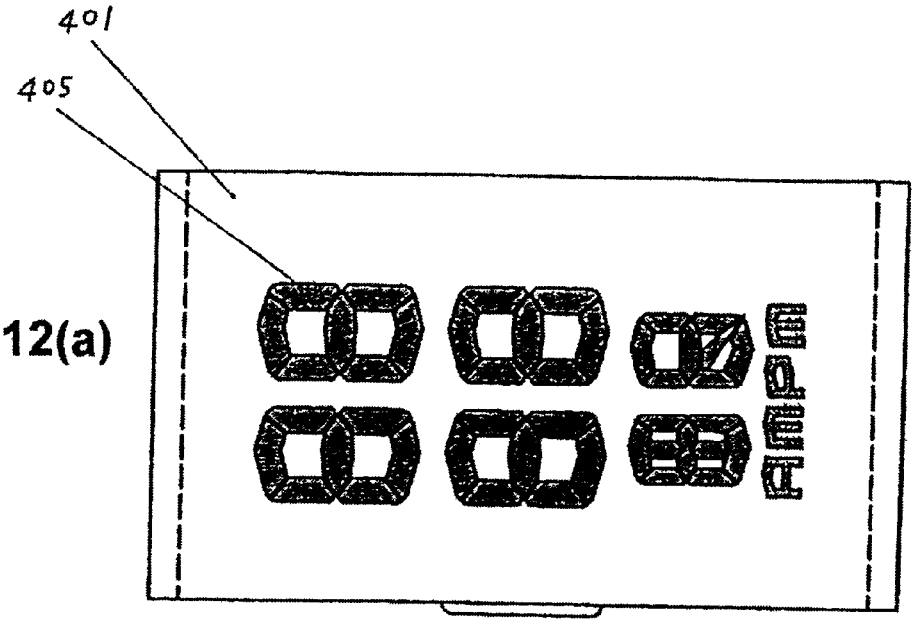
FIGS. 12(*a*) and 12(*b*) are top views showing the respective segments of the upper layer liquid crystal display panel and the lower layer liquid crystal display panel of the display apparatus in FIG. 11.
Figure 12B:
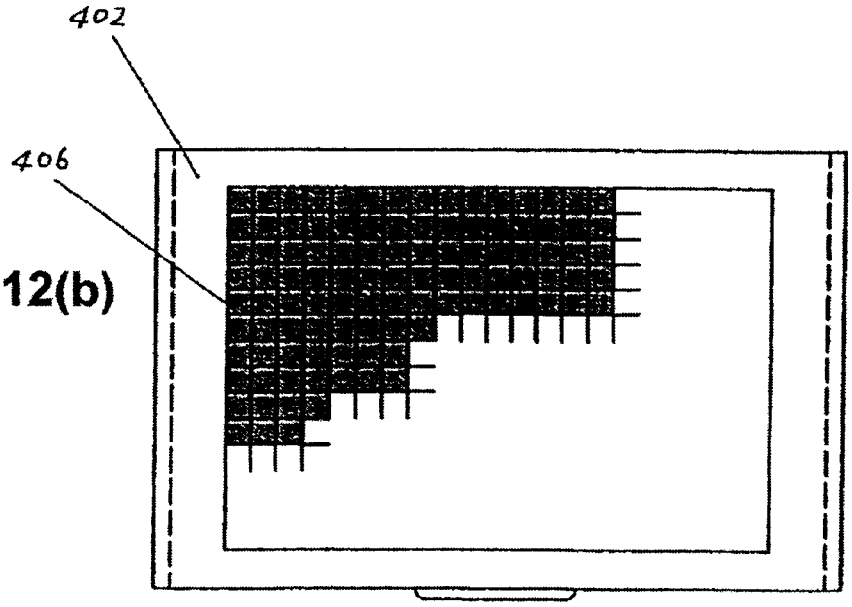
Figure 13A:
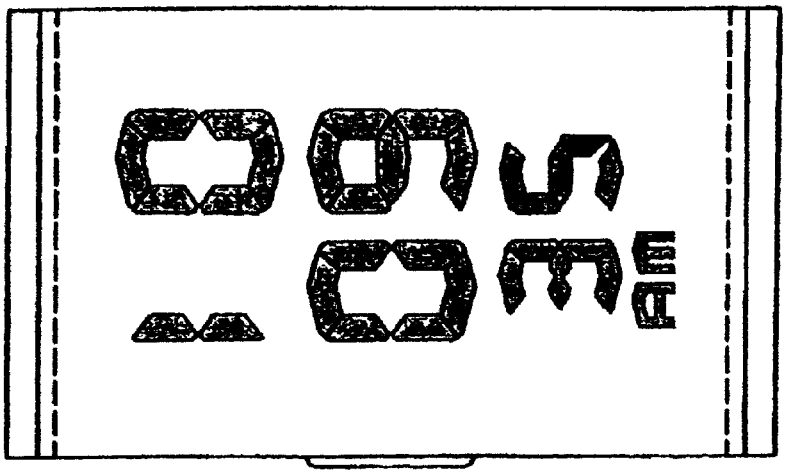
FIGS. 13(*a*) and 13(*b*) are top views respectively showing the information display states of the display apparatus in FIG. 11 for the upper layer liquid crystal display panel and for the lower layer liquid crystal display panel.
Figure 13B:
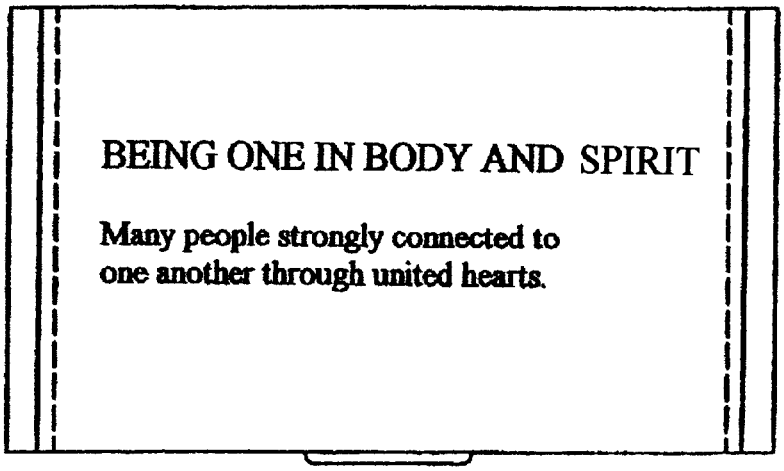

Next, the display operation of the multifunction digital electronic watch, which is the electronic device according to the present invention of FIG. 11, will be described with reference to FIGS. 12(*a*), 12(*b*), 13(*a*) and 13(*b*). FIGS. 13(*a*) and 13(*b*) represent the superimposed state of the upper layer liquid crystal display panel 401 of FIG. 12(*a*) and the lower layer liquid crystal display panel 402 (64 dots vertical×256 dots horizontal) of FIG. 12(*b*). The information generating means 102 outputs only the information from the time information generator 121 based on control of the mode switching section 151 of FIG. 11, and the relevant information passes the above-mentioned upper layer liquid crystal driver circuit 301 to drive the upper layer liquid crystal display panel 401 for display operations. As a result, FIG. 13(*a*) shows a state where the time information is displayed on segments 405 of the 7-segment format of FIG. 12(*a*) and segments 406 of the dot-matrix format of FIG. 12(*b*) are not displayed (all segments in OFF state). Conversely, the information generating means 102 outputs only the information from the dictionary information generator circuit 122 based on control of the mode switching section 151 of FIG. 11, and the relevant information is input by the dot-matrix controller 323 and passes the above-mentioned lower layer liquid crystal driver circuit 322 to drive the lower layer liquid crystal display panel 402 of the dot-matrix format for display operations. As a result, the segments 405 of the 7-segment format of FIG. 12(*a*) are not displayed (all segments in OFF state) and the dictionary information "*" that was selected and displayed on the basis of the dictionary information selection operating section 152 of FIG. 11 is displayed on segments 406 of the dot-matrix format of FIG. 12(*b*).

Figure 14:
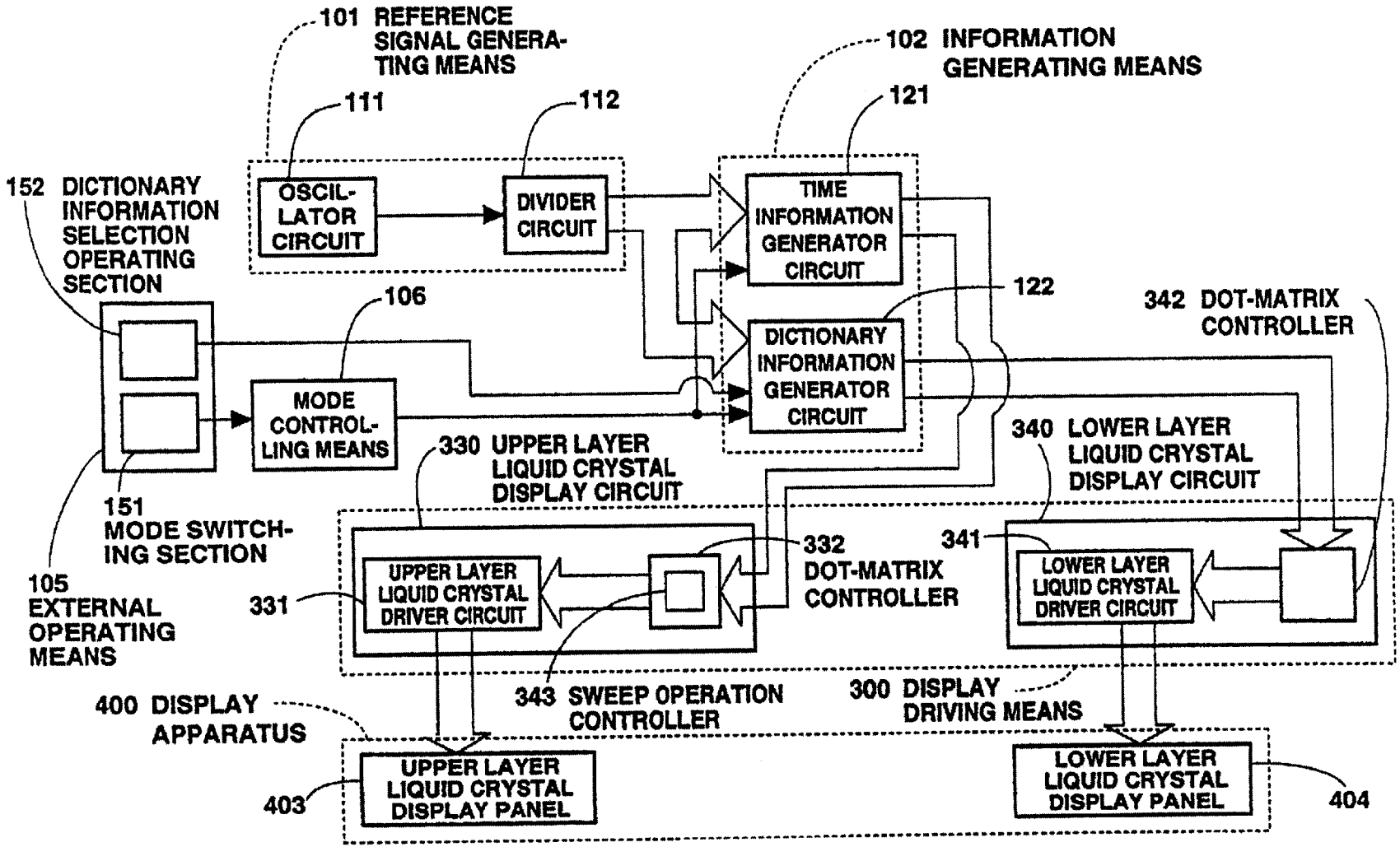
FIG. 14 is a block diagram showing the circuit configuration of a multifunction digital electronic watch of the fifth embodiment according to the present invention FIGS. 15(*a*) and 15(*b*) are top views showing the respective segments of the upper layer liquid crystal display panel and the lower layer liquid crystal display panel of the display apparatus in FIG. 14.

Next, the multifunction digital electronic watch of a fifth embodiment according to the present invention based on the circuit block diagram of FIG. 14 will be described. In FIG. 14, components that are identical to those in the circuit block diagram of the third embodiment of FIG. 8 are given the same reference numerals and their descriptions will be omitted. In FIG. 14, display driving means 300 comprises an upper layer liquid crystal display circuit 330 further comprising an upper layer liquid crystal driver circuit 331 and a dot-matrix controller 332 having a sweep operation controller 343, and a lower layer liquid crystal display circuit 340 further comprising a lower layer liquid crystal driver circuit 341 and a dot-matrix controller 342. A display apparatus 400 comprises an upper layer liquid crystal display panel 403, which is a dot-matrix display, and a lower layer liquid crystal display panel 404, which is also a dot-matrix display.

Figure 15A:
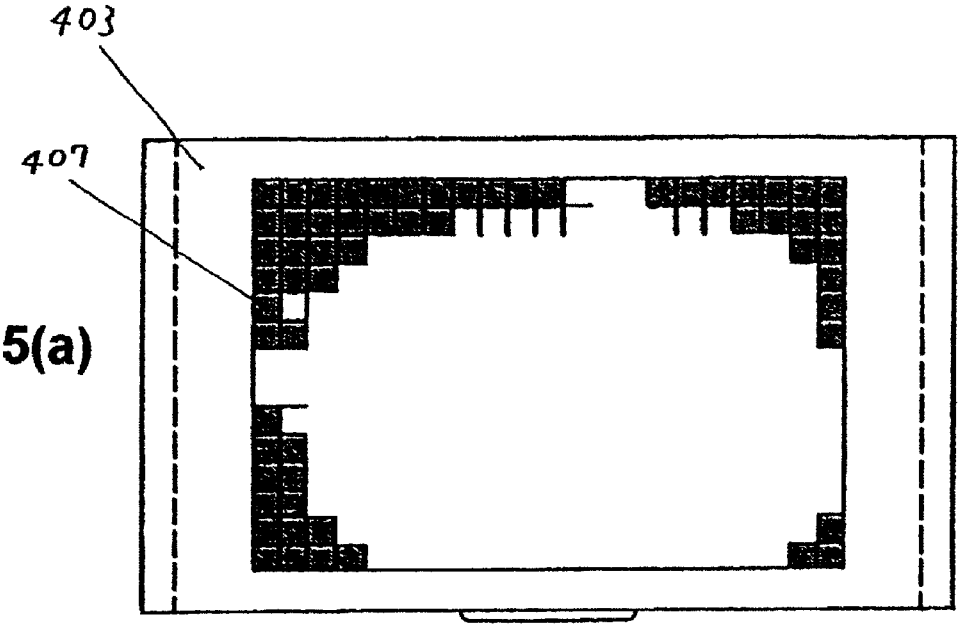
Figure 15B:
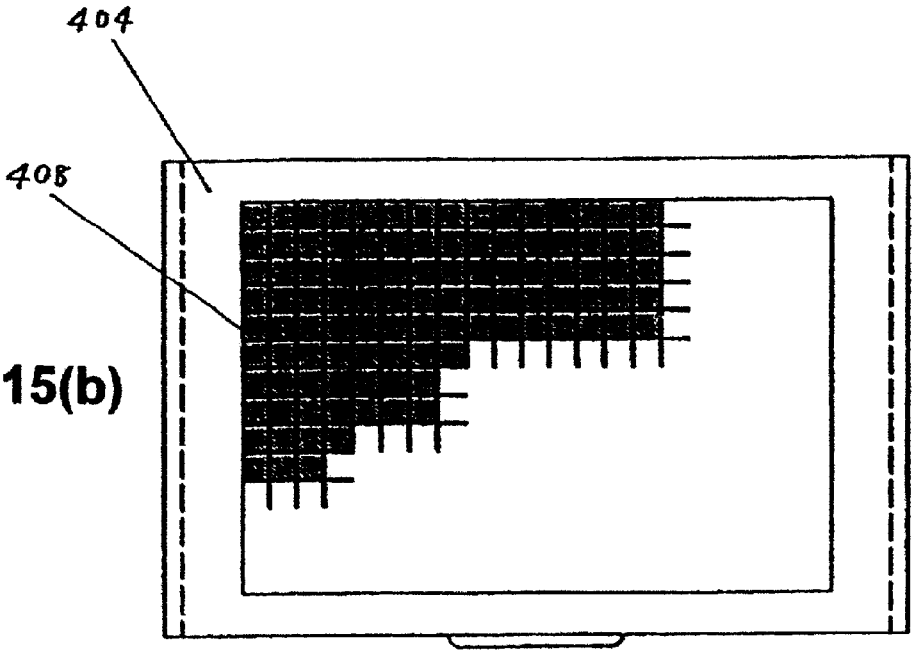
Figure 16A:
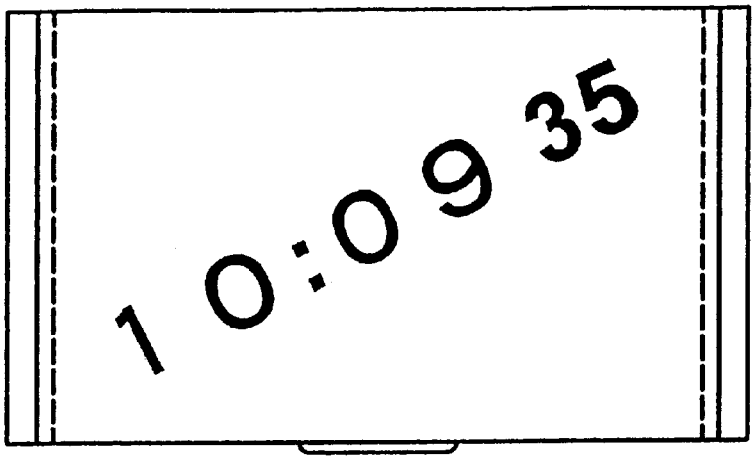
FIGS. 16(*a*) and 16(*b*) are top views respectively showing the information display states of the display apparatus in FIG. 14 for the upper layer liquid crystal display panel and for the lower layer liquid crystal display panel.
Figure 16B:
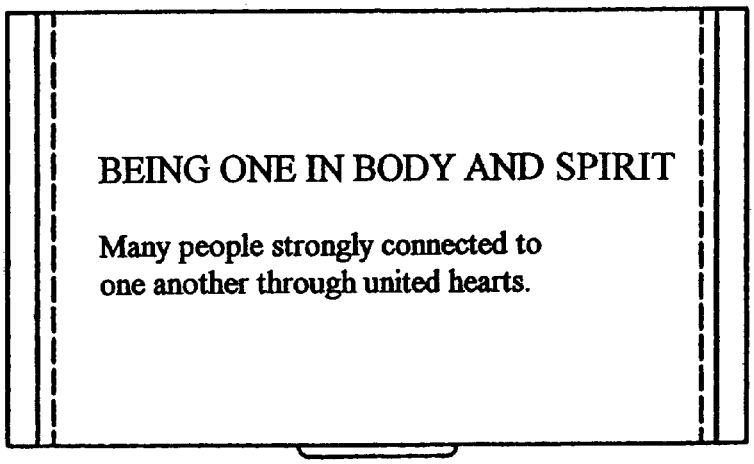

Furthermore, the display operation of the multifunction digital electronic watch, which is the electronic device according to the present invention of FIG. 14, will be described with reference to FIGS. 15(*a*), 15(*b*), 16(*a*) and 16(*b*). FIGS. 16(*a*) and 16(*b*) represent the superimposed state of the upper layer liquid crystal display panel 403 (64 dots vertical×256 dots horizontal) of FIG. 15(*a*) and the lower layer liquid crystal display panel 404 (64 dots vertical×256 dots horizontal) of FIG. 15(*b*). The information generating means 102 outputs only the information from the time information generator 121 based on control of the mode switching section 151 of FIG. 14, and the relevant information is input by the dot-matrix controller 332 and passes the above-mentioned upper layer liquid crystal driver circuit 331 due to control of the sweep operation controller 343 to drive the upper layer liquid crystal display panel 403 for sweep display operations. As a result, FIG. 16(*a*) shows a state where the time information is displayed in a sweep manner on segments 407 of the upper layer dot-matrix format of FIG. 15(*a*), and segments 408 of the dot-matrix format of FIG. 15(*b*) are not displayed (all segments in OFF state). (The display in FIG. 15(*a*) shows a state where the entire time display appears when the time information is displayed in a sweep manner.) Conversely, the information generating means 102 outputs only the information from the dictionary information generator circuit 122 based on control of the mode switching section 151, and the relevant information is input by the dot-matrix controller 342 and passes the above-mentioned lower layer drive circuit 341 to drive the lower layer liquid crystal display panel 404 for display operations. As a result, FIG. 16(*b*) shows a state where segments 407 of the dot-matrix format of FIG. 15(*a*) are not displayed (all segments in OFF state), and the dictionary information "*" that was selected and displayed on the basis of the dictionary information selection operating section 152 of FIG. 14 is displayed on segments 408 of the dot-matrix format of FIG. 15(*b*).

Figure 17A:
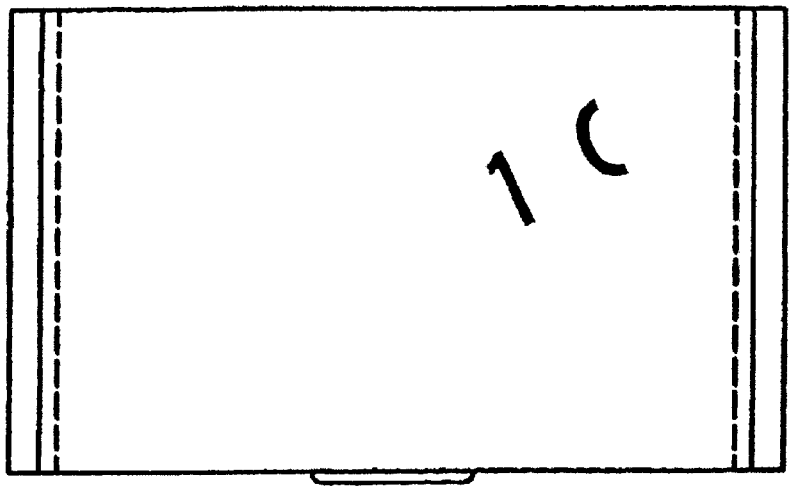
FIGS. 17(*a*)–17(*c*) are top views showing the sweep operating states on the dot-matrix display panel in the fifth embodiment of FIG. 14.
Figure 17B:
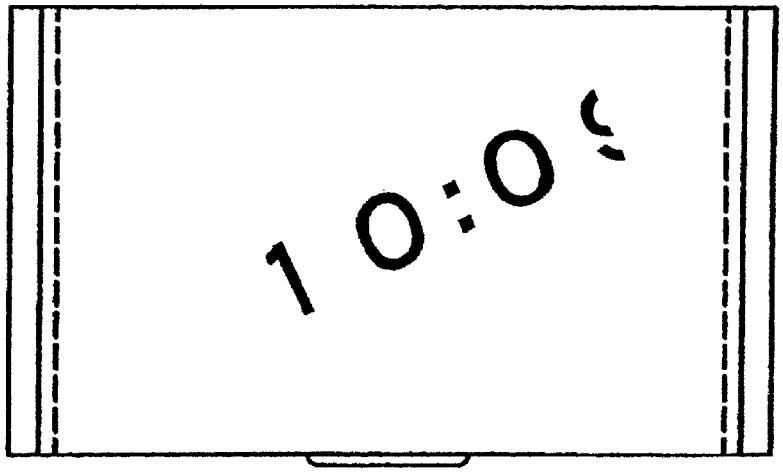
Figure 17C:
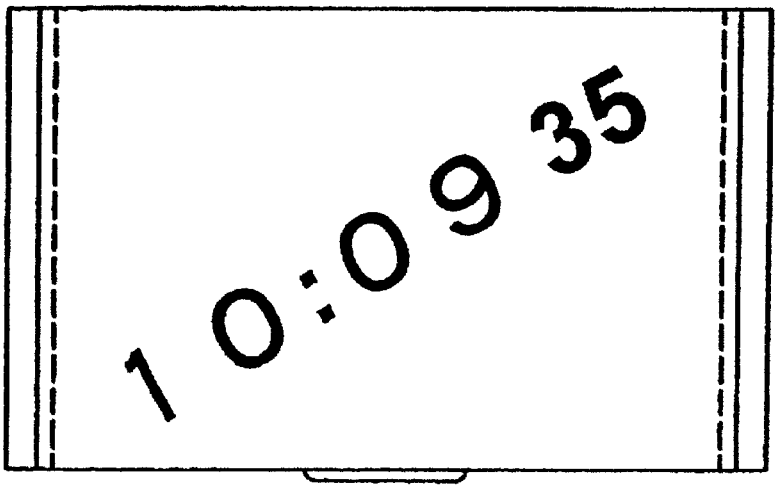

FIGS. 17(*a*), 17(*b*) and 17(*c*) show the time information of FIG. 16(*a*) displayed in a sweep manner by control of the sweep operation controller 343 of FIG. 14, which controls the sweep operation. A series of operating states where the information display undergoes the sweep operation on the liquid crystal display panel of the dot-matrix format is shown in sequence in FIGS. 17(*a*), 17(*b*), and 17(*c*).

Figure 18:
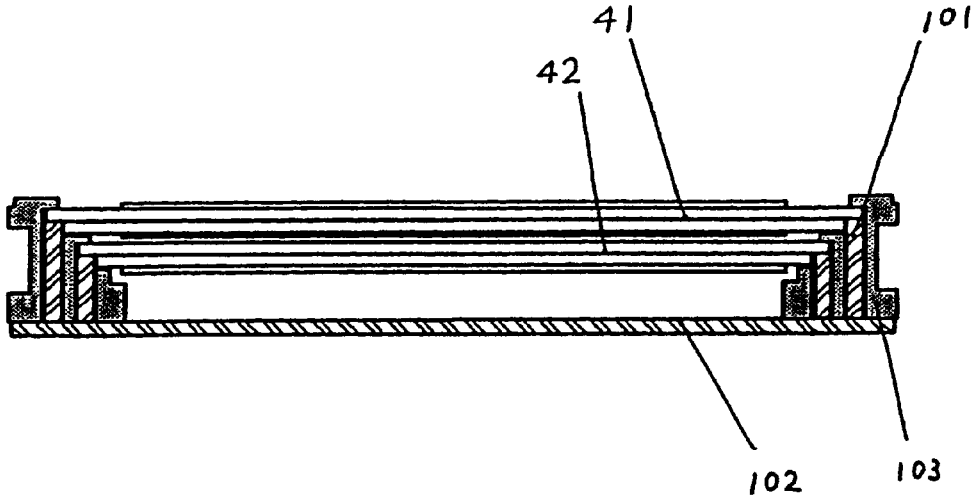
FIG. 18 is a cross-sectional view of an example structure of a two-layer liquid crystal display panel that is used in the third through fifth embodiments according to the present invention.

FIG. 18 is a cross-sectional view showing the structure of the liquid crystal display of the two-layer multifunction digital electronic watch (a detailed description of which will be given hereinafter with reference to FIGS. 19 and 20) with the upper layer liquid crystal display panel and the lower layer liquid crystal display panel in an overlapped arrangement, namely, the state of viewing FIGS. 10(*a*), 10(*b*), 13(*a*), 13(*b*), 16(*a*) and 16(*b*) from the side.

The foregoing described the electronic device according to the present invention in which at least one layer of the two-layer display panel according to the present invention in the third, fourth, and fifth embodiments is of the dot-matrix format.

Although the third, fourth, and fifth embodiments showed examples where at least one complete layer of the two-layer display panels was of the dot-matrix format, the same effect can also be obtained when part of one layer of the two-layer display panels is of the dot-matrix format.

Furthermore, although the third, fourth, and fifth embodiments showed examples where at least one layer of the two-layer display panels was a relatively high-resolution dot matrix of 64 dots vertical×256 dots horizontal, the same effect can also be obtained with a low-resolution dot matrix of 12 dots vertical×48 dots horizontal.

Furthermore, although the third, fourth, and fifth embodiments showed examples of character or numeric information on the display panel of the dot-matrix format of at least one layer of the two-layer display panels, anything such as a picture or graphic that can be expressed on the display panel of the dot-matrix format is permitted, and by providing an animation controller instead of the sweep operation controller 343, an animated display of pictures can also be considered to be part of the display information according to the present invention, yielding the same effect of presenting the user with more display information.

According to the above-mentioned third through fifth embodiments, various types of information, such as characters, symbols, and numerals, or pictures and graphics, can be displayed by driving a display panel, such as a liquid crystal display panel having subdivided segments on at least one layer of a dot-matrix format, two-layer display apparatus. Thus, more information can be presented to the user on electronic device at the height of the PDA (Personal Digital Assistant) age in the present day information-oriented society.

Furthermore, by applying the sweep operation to the information display on the display panel of the dot-matrix format, the PDA (Personal Digital Assistant) or the like can be realized as electronic device without any need for concern regarding the amount of information to be displayed.

Figure 19:
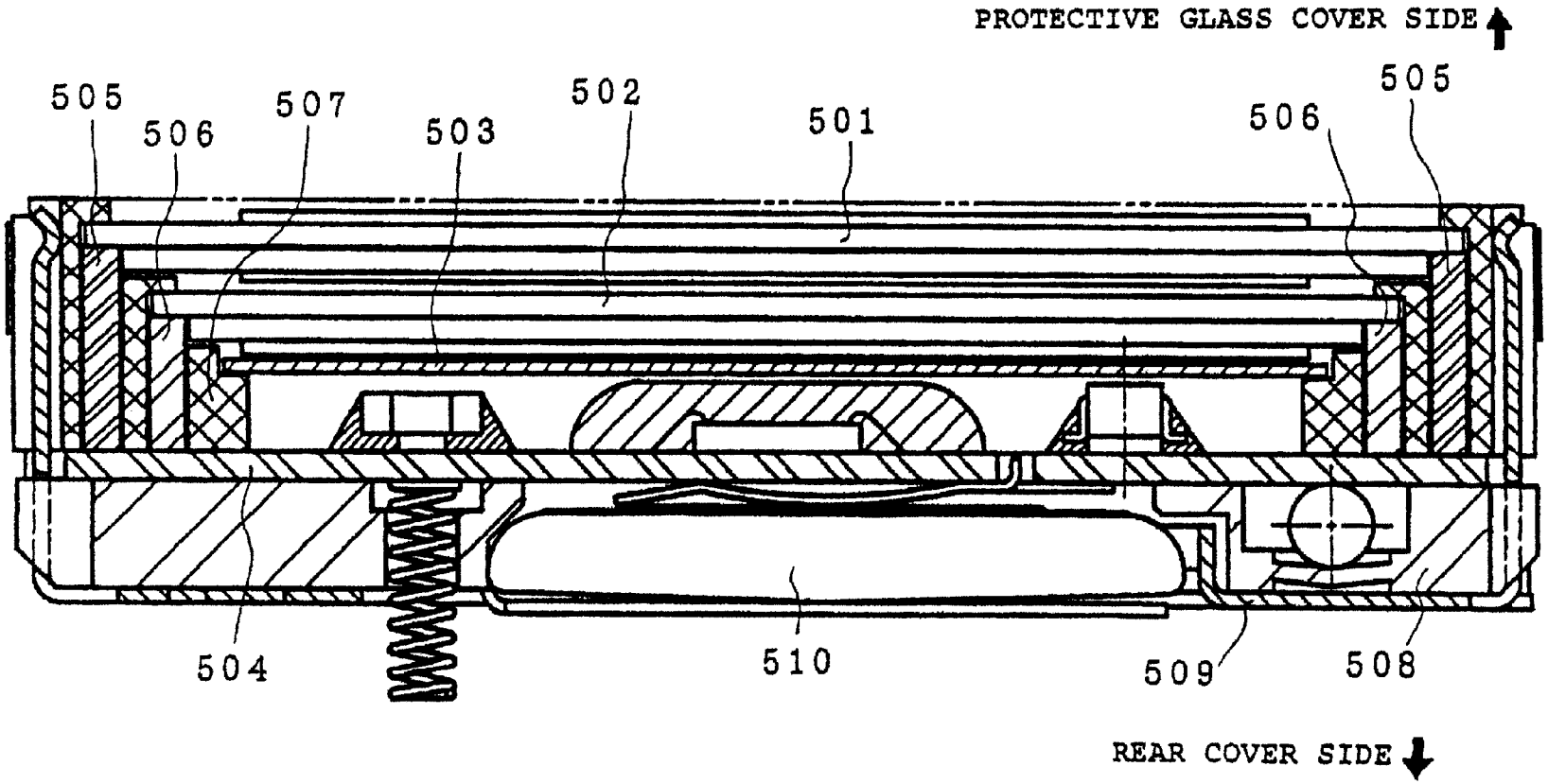
FIG. 19 is a cross-sectional view of a watch module in the sixth embodiment of the present invention.

FIG. 19 is a cross-sectional view of a watch module for a sixth embodiment according to the present invention. The upper side of the drawing is a protective glass cover side of the watchcase. The structure has two overlapping TN-type liquid crystal cells, a liquid crystal cell 501 and a liquid crystal cell 502, and underneath the liquid crystal cell 502 is arranged an EL panel 503 for illumination, which functions as a backface member. The surface of the EL panel 503 is printed blue so that when the EL panel 503 is turned on with the watch operating member (not shown), an EL panel driving signal is transmitted from a circuit board 504 via a rubber connector (not shown) to cause the EL panel 504 to illuminate a blue color.

The liquid crystal cell 501 and the liquid crystal cell 502 of FIG. 19 are held by a liquid crystal cell support frame 507, and the circuit board 504 and a circuit support 508 are both securely fastened by hooks (not shown) on the liquid crystal cell support frame 507.

Furthermore, FIG. 19 is a lengthwise cross-sectional view of the 12 to 6 o'clock direction of the watch module. Although the liquid crystal cell 501 and the liquid crystal cell 502 have the same width in the 3 to 9 o'clock widthwise direction (not shown), the liquid crystal cell 502 on the side of a battery 510 is shorter along the lengthwise direction than the liquid crystal cell 501 on the protective glass cover side because electrode terminals for the liquid crystal cells 501, 502 are arranged along the 12–6 o'clock direction. Furthermore, the EL panel 503, having substantially the same shape as the liquid crystal cell 501 and the liquid crystal cell 502, is arranged underneath the liquid crystal cell 502 so as to illuminate the entire liquid crystal cell surface.

Furthermore, liquid crystal cell driving signals from the circuit board 504 are transmitted to the liquid crystal cell 501 through an electrically conductive rubber connector 505 and to the liquid crystal cell 502 through a rubber connector 506.

Figure 20:
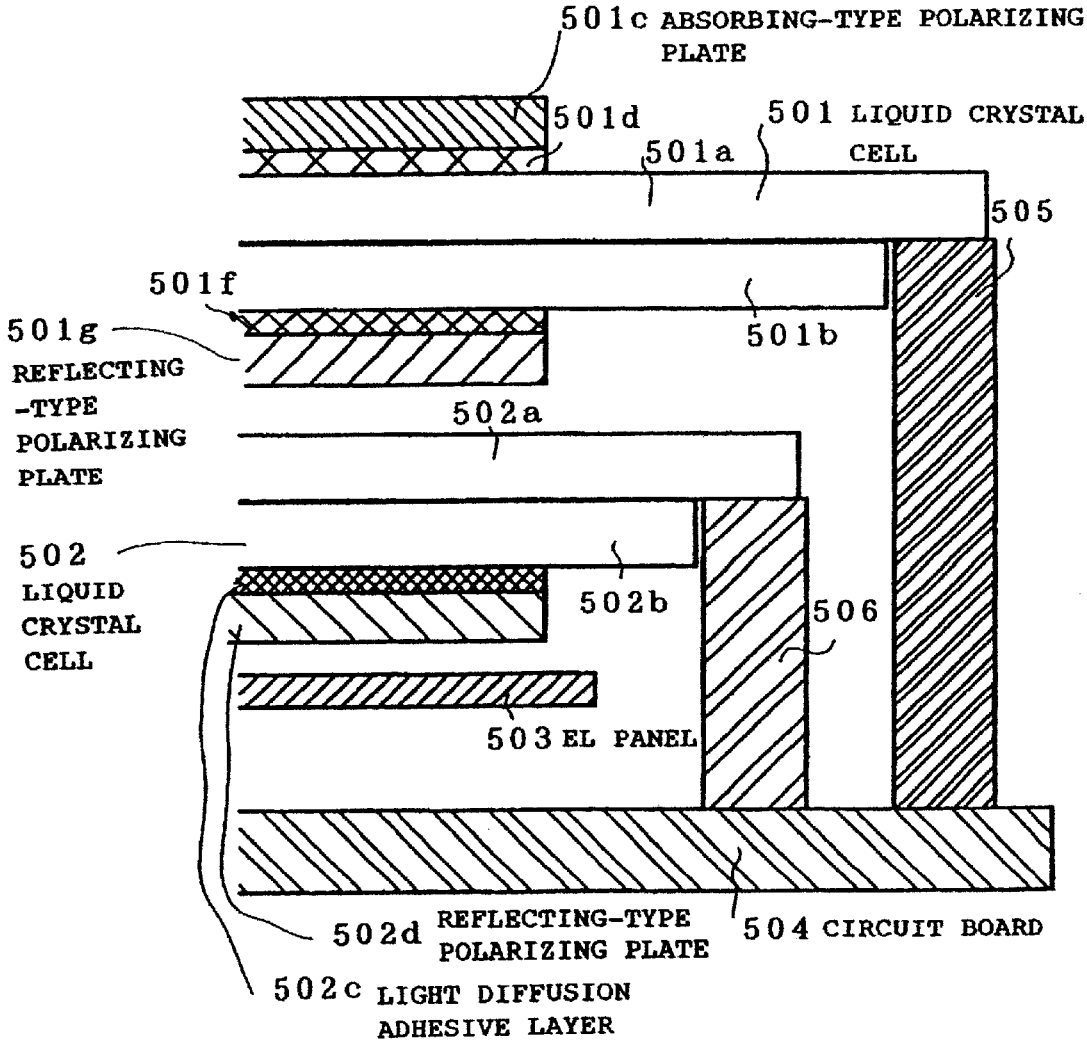
FIG. 20 is an enlarged cross-sectional view showing part of the structure of the liquid crystal display apparatus of FIG. 19 with part of the liquid crystal cell support frame and so forth omitted.

FIG. 20 is an enlarged cross-sectional view showing the configuration of the liquid crystal display apparatus of FIG. 19 with part of the liquid crystal cell support frame and so forth omitted. In the liquid crystal cell 501 on the upper side, an absorption-type polarizing plate 501*c* having an adhesive 501*b* is affixed as an uppermost layer polarizing plate to the top surface of a top glass 501*a*, and a reflecting-type polarizing plate 501*g* having an adhesive 501*f* is affixed as a middle-layer polarizing plate to the bottom surface of a bottom glass 501*b*.

Furthermore, a reflecting-type polarizing plate 502*d* having a light diffusion adhesive layer 502*c* with a property of diffusing light is affixed as a lowest layer polarizing plate to the bottom surface of a lower glass 502*b* of the liquid crystal cell 502. The top surface of the liquid crystal cell 502 does not have a polarizing plate because the polarizing plate 501*g* of the liquid crystal cell 501 can also be used as a polarizing plate for the top surface of the liquid crystal cell 502.

Figure 21:
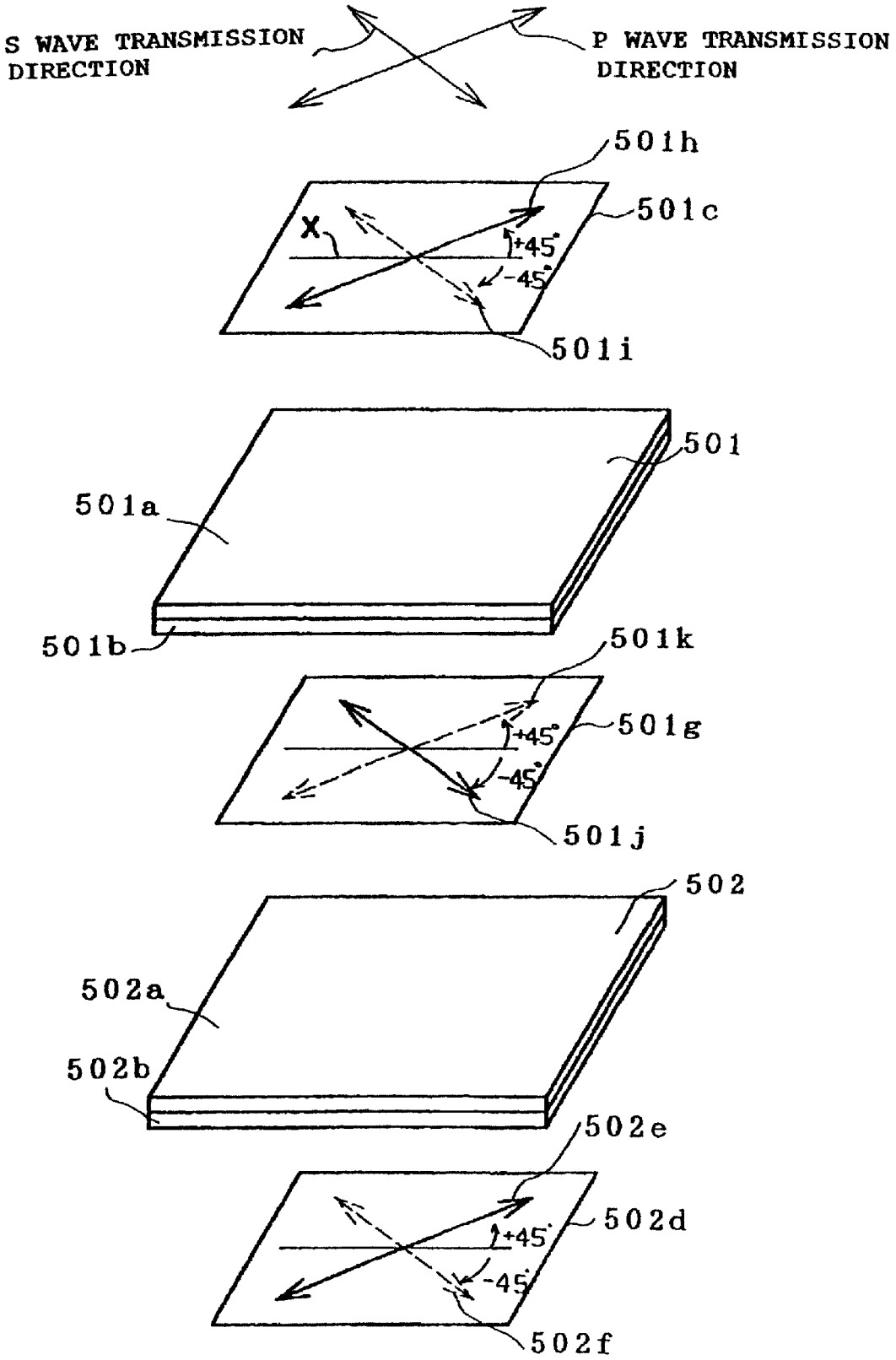
FIG. 21 is an explanatory perspective view representing the directions of the polarized light axes of the polarizing plates affixed to the liquid crystal cells of FIG. 19.

FIG. 21 shows the directions of the polarized light axes of the three polarizing plates 501*c*, 501*g*, and 502*d* that are affixed to the two liquid crystal cells 501 and 502.

Assuming the lengthwise direction of the liquid crystal cell 501 is the direction of the X axis and the counterclockwise direction is positive, a polarized light axis 501*h* of the absorption-type polarizing plate 501*c* that is affixed to the top surface of the liquid crystal cell 501 is +45 degrees and an absorption axis 501*i* is −45 degrees, a polarized light axis 501*j* of the reflecting-type polarizing plate 501*g* at the bottom surface of the liquid crystal cell 501 is −45 degrees with respect to the X axis and a reflecting axis 501*k* is +45 degrees, and a polarized light axis 502*e* of the reflecting-type polarizing plate 502*d* on the bottom surface of the liquid crystal cell 502 is +45 degrees with respect to the X axis and a reflecting axis 502*f* is −45 degrees. When no voltage is applied, the liquid crystal display is in a normally open state in which light is transmitted.

Light is an electromagnetic wave and oscillates in various directions. The light transmitted through the absorption-type polarizing plate 501*c* that is affixed to the top surface of the liquid crystal cell 501 in FIG. 21 is designated wave P, and the light having its oscillation plane shifted by 90 degrees with respect to wave P and oriented so as not to be transmitted through the absorption-type polarizing plate 501*c* is designated wave S. Thus, the reflecting-type polarizing plate 501*g* is affixed in the transmitting direction of wave S and the reflecting-type polarizing plate 502*d* is affixed in the transmitting direction of wave P.

Furthermore, when light enters the absorption-type polarizing plate, only the light in the direction of the polarized light axis is transmitted, and the light having its oscillation plane shifted by 90 degrees has its thermal energy absorbed by the polarizing plate. In contrast, the reflecting-type polarizing plate has a characteristic in which the light in the direction of the polarized light axis is transmitted and the light having its oscillation plane shifted by 90 degrees is reflected. The oscillation direction of the reflected light is designated the reflecting axis.

Furthermore, the reflecting-type polarizing plate has a multi-layer thin-film structure of polyester-based resin film and combines a conventional reflecting plate and an absorption-type polarizing plate.

The liquid crystal cells 501 and 502 each respectively has the outer perimeters of two plates of glass 501*a* and 501*b*, and two plates of glass 501*b* and 502*a* bonded with a sealant (not shown), and has liquid crystal material (not shown) injected in the gaps. Furthermore, the inner surfaces of the bonded glass plates 501*a* and 501*b*, and glass plates 502*a* and 502*b* are finished with a rubbing process that adds fine lines in directions identical to that of polarized light axes 501*h*, 501*j*, and 502*e* of the polarizing plates 501*c* , 501*g*, and 502*d*, and electrodes shaped as segments and characters are arranged with transparent ITO film (not shown) that is electrically conductive.

The rubbing processes are shifted by 90 degrees between the top glass and bottom glass of the liquid crystal cells for the TN-type liquid crystal, and the liquid crystal material having a long molecular structure has a property of aligning with the lines provided by the rubbing process. Thus, when a voltage is not applied to the electrodes, the liquid crystal molecules are aligned 90 degrees apart between the upper and lower liquid crystal layers. On the other hand, when a voltage is applied to the electrodes, the liquid crystal molecules align facing the direction of the electric field.

Next, the change in the display will be described with reference to FIGS. 22 and 23 when a liquid crystal driving voltage is applied to transparent electrodes provided on the two liquid crystal cells 501 and 502.

As shown in FIG. 21, the reflecting-type polarizing plate 501*g* is affixed in the transmitting direction of wave S in which the polarized light axis direction is shifted by 90 degrees with respect to the absorption-type polarizing plate 501*c*, and the reflecting-type polarizing plate 502*d* is affixed in the transmitting direction of wave P in the same manner as the absorption-type polarizing plate 501*c*.

Figure 22:
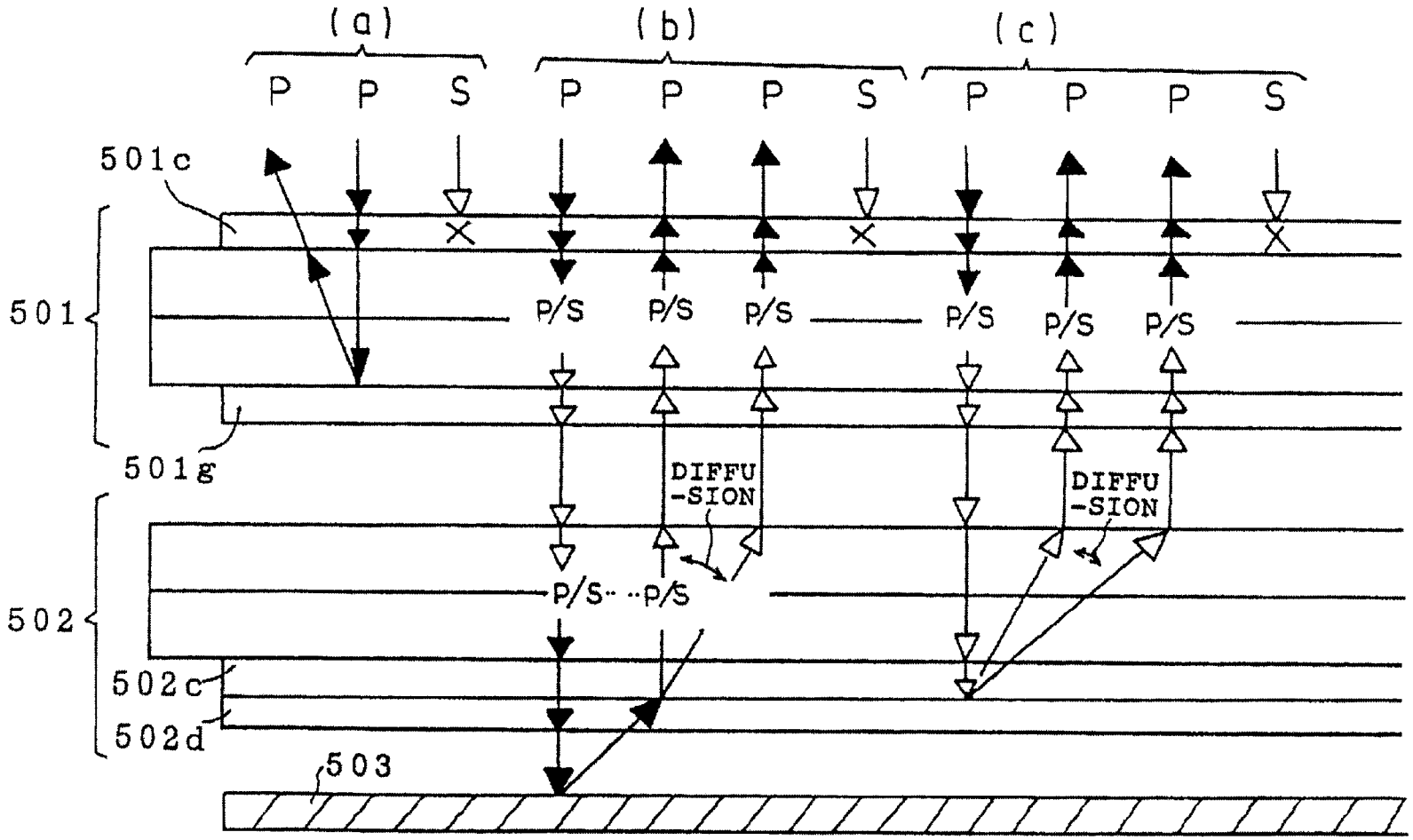
FIG. 22 is an explanatory cross-sectional view of the liquid crystal cells illustrating the transmission state when ambient light enters the liquid crystal display apparatus of FIG. 19.

First, FIG. 22(*a*) shows a state where a voltage is applied to the electrode (not shown) of the liquid crystal cell 501. At this time, only wave P indicated by the black arrows of the ambient light is transmitted through the absorption-type polarizing plate 501*c*, the liquid crystal molecules align in the vertical direction of the electric field since a voltage is applied to the electrode of the liquid crystal cell 501, and wave P is travels straight through the liquid crystal layer without being polarized. The light traveling straight has a polarized light axis that is 90 degrees shifted with respect to the polarized light axis 501*j* of the reflecting-type polarizing plate 501*g* and coincides with the reflecting axis 501*k* so that the incident light is reflected back by the reflecting-type polarizing plate 501*g* Although omitted in FIG. 22(*a*), at this time, the reflecting-type polarizing plate 501*g* of the liquid crystal cell 501 looks like a mirror since light is reflected so that the angle of incidence and the angle of reflection are equal.

At this time, wave S indicated by the white arrows of the ambient light is not transmitted and is absorbed by the absorption-type polarizing plate 501*c* that is affixed in the transmitting direction of wave P.

Next, FIG. 22(*b*) shows a state in which voltage is not applied to the electrodes of the liquid crystal cell 501 and the liquid crystal cell 502. Wave P that was transmitted through the absorption-type polarizing plate 501*c* turns into wave S resulting from the oscillation direction of the light being rotated 90 degrees by the direction of twist of the liquid crystal molecules since voltage is not applied to the electrode of the liquid crystal cell 501, and is transmitted through the reflecting-type polarizing plate 501*g* that is affixed in the transmitting direction of wave S.

P/S shown in FIG. 22(*b*) and so forth indicates wave P has polarized into wave S or wave S has polarized into wave P.

Furthermore, unless voltage is applied to the electrodes of the liquid crystal cell 502, the oscillation plane rotates for conversion to wave P at the liquid crystal layer of the liquid crystal cell 502 similar to liquid crystal cell 501. The reflecting-type polarizing plate 502*d* is affixed with a property of transmitting wave P so that the light is transmitted until it reaches the EL panel 503 where the color of the EL plate is reflected and returns along the incident path. The light diffuses into a wide angle when passing through the diffusion adhesive layer 502*c* and the color of the EL plate can be seen from the protective glass side.

Next, FIG. 22(*c*) shows a state in which a voltage is not applied as shown in FIG. 22(*b*) to the electrodes of the liquid crystal cell 501 and a voltage is applied to the electrodes of the liquid crystal cell 502. Wave P that is transmitted through the liquid crystal cell 501 is converted into wave S, and the oscillation plane of the light travels straight without rotation at the liquid crystal cell 502 and remains as wave S when reaching the reflecting-type polarizing plate 502*d*. At this time, the reflecting-type polarizing plate 502*d* is affixed in a direction to transmit wave P so that the incident wave S is not transmitted and is reflected. When the reflected light passes through the diffusion adhesive layer 502*c*, the light is diffused and is returned to the protective glass via its original path. The reflecting-type polarizing plate 501*g* of the liquid crystal cell 501 shown in FIG. 22(*a*) looks like a mirror since light is reflected so that the angle of incidence and the angle of reflection are equal. The light is diffused by the liquid crystal cell 502 and the diffusion adhesive layer 502*c* so that the reflected light appears white.

If the reflecting-type polarizing plate 502*d* is configured with an absorption-type polarizing plate, the light is not reflected and is absorbed to result in a problem where the display screen becomes dark. According to the above-mentioned configuration, a bright white display can be realized instead.

If the color of the EL panel 503 is white or a pale color, it becomes difficult to see the difference between the electrode and the background. Thus, it is desirable for the EL panel 503 to be colored for when light is emitted and for when light is not emitted.

Figure 23:
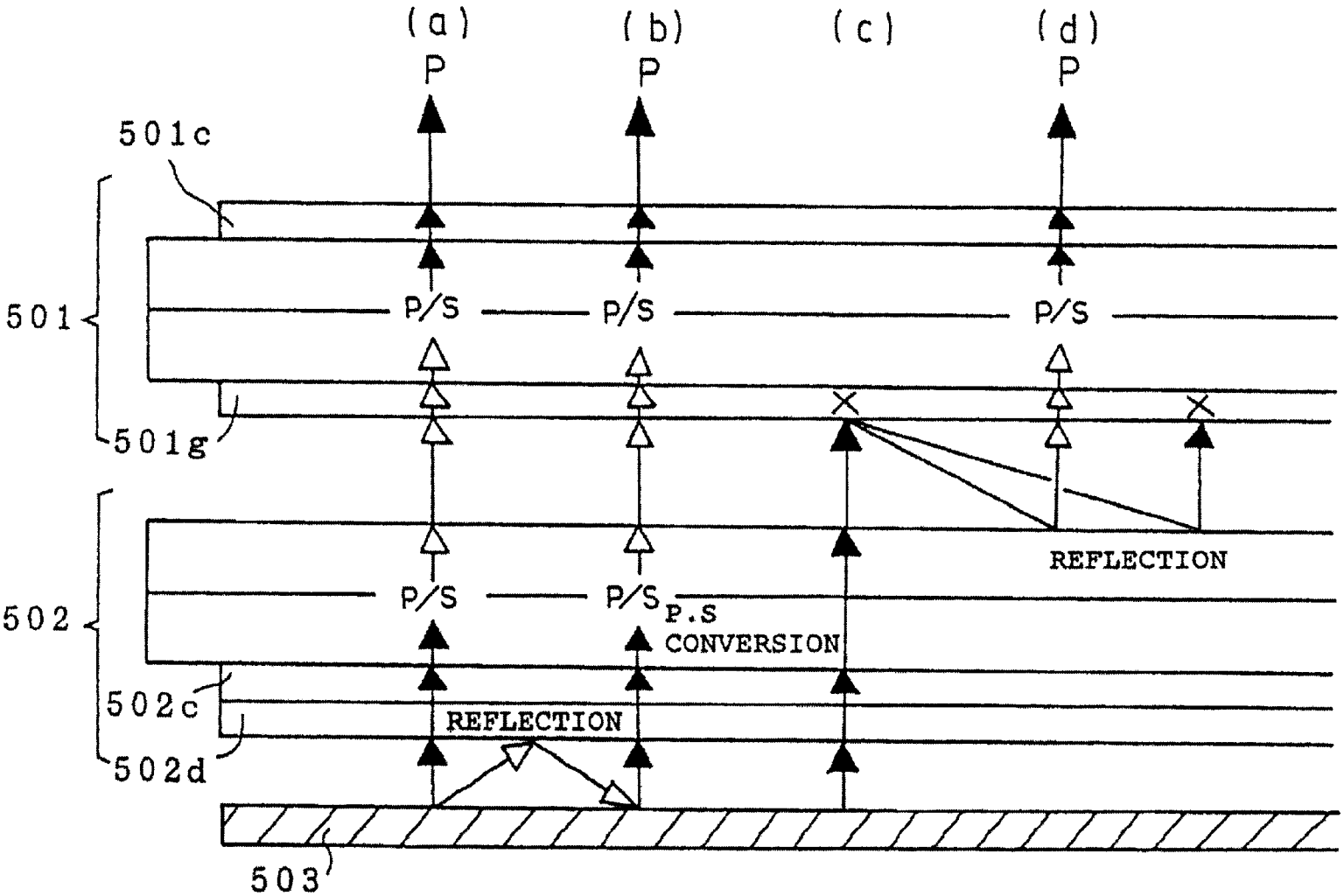
FIG. 23 is an explanatory cross-sectional view of the liquid crystal cells illustrating the transmission state when EL light enters the liquid crystal display apparatus of FIG. 19.

Next, FIG. 23 shows a state where the EL panel 503 is turned on. FIG. 23(*a*) shows a state where the EL panel 503 is in the ON state and voltage is not applied to the electrodes of the liquid crystal cell 501 and the liquid crystal cell 502. Of the emitted light S and P from the EL panel 503, wave P indicated by the black arrows is transmitted through the reflecting-type polarizing plate 502*d* that is affixed in the transmission direction of wave P, is converted to wave S indicated by the white arrows since a voltage is not applied to the electrodes of the liquid crystal cell 502, further is transmitted through the reflecting-type polarizing plate 501*g* that is affixed to the liquid crystal cell 501 so as to transmit wave S, is converted to wave P since a voltage is not applied to the electrodes at the liquid crystal cell 501, and the EL emitted light color is emitted to the protective glass side.

Furthermore, FIG. 23(*b*) shows a state, among the states in which the EL is turned on in FIG. 23(*a*), where wave S that was reflected by the reflecting-type polarizing plate 502*d* for wave P transmission is reflected back from the EL panel 503. In this case, part of wave S is reflected and converted to wave P, and the recreated wave P also is transmitted through the reflecting-type polarizing plate 502*d*.

Furthermore, FIG. 23(*c*) shows a case where the EL panel 503 is turned on in a state where a voltage is not applied to the electrodes of the liquid crystal cell 501 and a voltage is applied to the electrodes of the liquid crystal cell 502. The state is shown where wave P emitted from the EL panel 503 is transmitted through the reflecting-type polarizing plate 502*d* of the liquid crystal cell 502 and is transmitted as wave P since a voltage is applied to the electrodes. At this time, it cannot be transmitted through the liquid crystal cell 501 since the reflecting-type polarizing plate 501*g* of the liquid crystal cell 501 has the property of transmitting wave S.

However, as shown in FIG. 23(*d*), the reflected wave P of FIG. 23(*c*) is partially converted by the reflection to wave S and is transmitted through the reflecting-type polarizing plate 501*g* with the property of transmitting wave S of the liquid crystal cell 501. Wave S that was transmitted through the reflecting-type polarizing plate 501*g* is converted to wave P since a voltage is not applied to the liquid crystal cell 501, and the EL light appears on the protective glass side.

As described in FIGS. 23(*a*) through (*d*), when the EL panel 503 is on, the linearly emitted light from the EL panel 503 is not only wave P. As described in FIG. 23(*b*), wave P is recreated when wave S is reflected from the reflecting plate 502*d,* and wave S is recreated from the reflection at the reflecting-type polarizing plate 501*g* as described in FIG. 23 (*c*) and (*d*). Thus, Figs. (b), (c), and (d) besides FIG. 23 (*a*) are added so as to yield an effect where the watch user sees a display brighter than that of the conventional watch.

Furthermore, the transmission and reflection states of wave S in FIG. 23(*c*) are identical to those described in FIG. 23(*b*).

Figure 24:
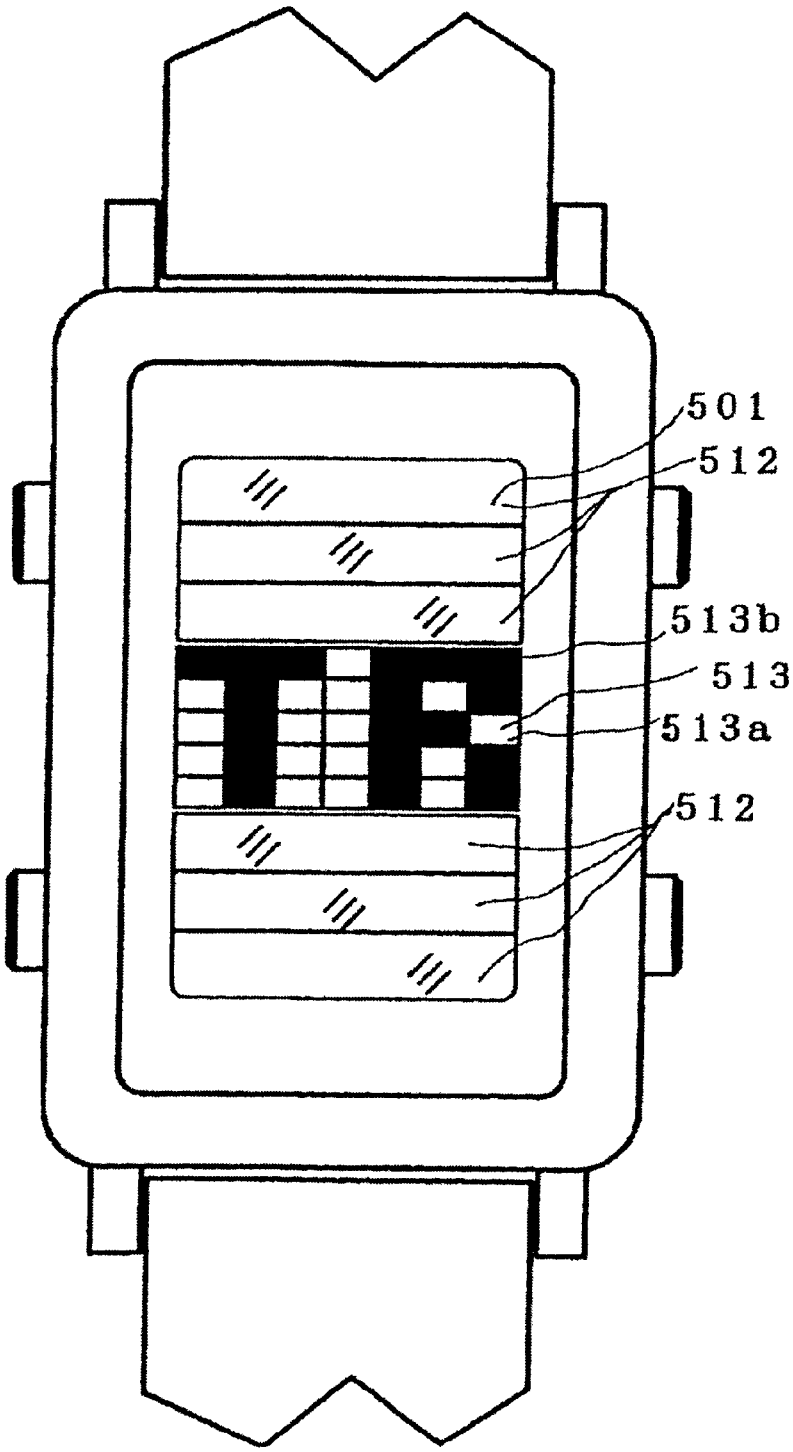
FIG. 24 is a top view of a display example of the watch shown in FIG. 19.
Figure 25:
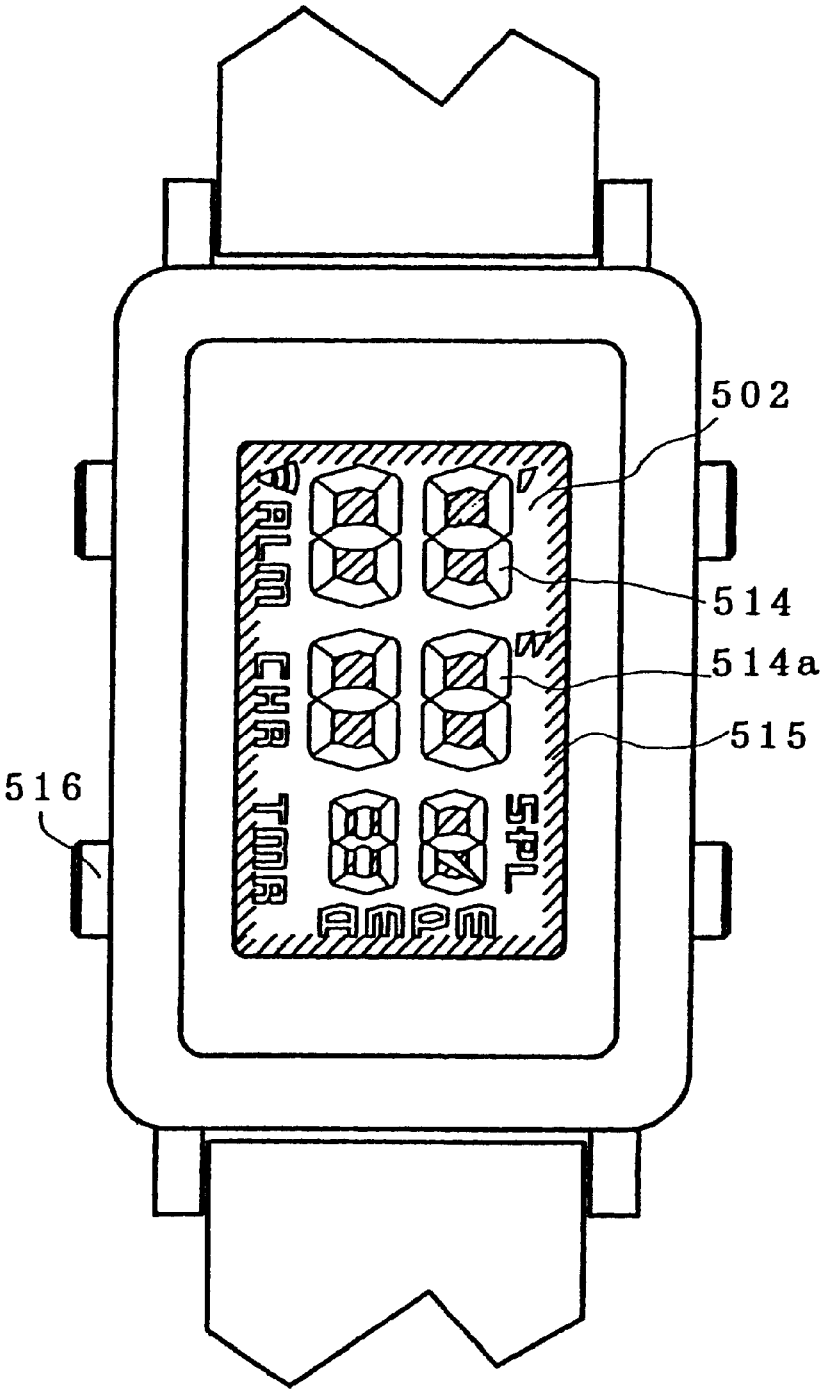
FIG. 25 is a top view of a display example of the watch shown in FIG. 19.

FIGS. 24 and 25 are display examples of the watch according to the present invention.

First, FIG. 24 shows the liquid crystal cell 501 provided at the top and bottom with a three-row horizontal pattern 512 and in the middle with a 5×7 rectangular dot matrix 513. In FIG. 24, a voltage can be applied to all the electrode patterns on the liquid crystal cell 501 as described in FIG. 22(*a*) so as to create an entire mirror surface.

Furthermore, characters can be displayed for mode displays, seconds display, and graphics display on the middle rectangular dot matrix 513.

FIG. 24 shows a mode display being performed on the rectangular dot matrix 513 where a white rectangle 513*a* and the horizontal pattern 512 are parts that appear like a mirror as described above and represent the driven state of FIG. 22 (*a*). Furthermore, a black rectangle 513*b* is the state described in FIG. 4(*b*), and represents the state where the voltages to the liquid crystal cell 501 and the liquid crystal cell 502 are off and where the base of the EL panel 503 can be seen. Namely, in this state, "TR" (abbreviation of Timer Mode) is displayed on a mirror-like background.

FIG. 25 shows a light transmission state with no voltage applied to all the electrodes of the liquid crystal cell 501 so that the entire display of the liquid crystal cell 502 can be seen. A voltage is applied to an electrode pattern 514 of the liquid crystal cell 502 so that all segments are turned on and displayed, which is shown in the state of FIG. 22(*c*). As shown in this figure, a watch according to the sixth embodiment is provided with partially modified 7-segment display patterns of two digits and three rows, and patterns for mode symbols and the like, and features functions for time, alarm, chronograph, and timer.

At this time, the light reflected by the reflecting-type polarizing plate 502*d* of the liquid crystal cell 502 as described in FIG. 22(*c*) is diffused by the light diffusion adhesive layer 502*c* so that a segment 514*a* appears much whiter and brighter from the diffusion than a configuration employing the conventional absorption-type polarizing plate.

Furthermore, a background 515 to which no voltage is applied represents the state of FIG. 22(*b*), and the light is reflected on the EL panel 503 so that the base color of the EL panel 503 is seen. Normally, the surface of the EL panel does not reflect much light, and the EL panel appears dark because the light is transmitted through the multi-layer liquid crystal cells and the polarizing plates. Therefore, in this state, the whiteness of the segment 514*a* is more effectively seen with excellent contrast.

Furthermore, when the EL panel 503 is turned on with a watch operating member 516, the segment 514*a* remains white and the background 515 appears bright in the color of the EL light, such as blue. Although this was described in FIG. 23, the light of the background 515, emitted not only with the light of wave P of FIG. 23(*a*) that was linearly emitted from the EL panel, but with the addition of wave P of FIG. 23(*b*) that was recreated by wave S reflected at the reflecting-type polarizing plate 502*d,* and the light from the recreation of wave S of FIGS. 23(*c*) and (*d*) that was recreated by the reflecting-type polarizing plate 501*g,* is brighter than the configuration employing the conventional absorption-type polarizing plate.

In the watch of the sixth embodiment, the display of the segment 512 and the rectangular dot matrix 513 of the liquid crystal cell 501 are sequentially turned off from the top to create a display similar to a closing shutter, thereby making it possible to achieve interesting display effects, such as random flashing of the display parts in the rectangular dot matrix 513.

Furthermore, by changing and affixing the polarized light axis of one or more polarizing plates among the three polarizing plates shown in FIG. 21, the background and segments can be arbitrarily combined from FIGS. (a), (b), and (c). As a result, the segment part can be illuminated with the EL light, or can be changed to a normally closed state in which the shutter is closed with voltage not applied to the liquid crystal cell. For example, in FIG. 21, when the reflecting-type polarizing plate 501*g* underneath the liquid crystal cell 501 is rotated 90 degrees then affixed, the liquid crystal cell 501 without voltage applied can achieve a normally closed state to become a mirror display.

As described in the foregoing, in the display apparatus having a plurality of overlapping liquid crystal cells, a backface member disposed on the lowest liquid crystal cell layer, and a plurality of polarizing plates, a light diffusion layer and a reflecting-type polarizing plate are disposed between the lowest liquid crystal cell layer and the backface member. This allows the light that was transmitted through the plurality of liquid crystal cells and reflected by the backface plate to diffuse, thereby solving a problem of dark display surfaces caused by the light being absorbed and not reflected when the conventional absorption-type polarizing plate is used. For example, a bright and white segment display can be realized as described in the foregoing.

Furthermore, when the backface member is an EL panel, not only the light of wave P linearly emitted from the EL panel, but also the light from wave P recreated by wave S reflecting from the reflecting plate and wave S recreated by reflecting from the reflecting-type polarizing plate are emitted so that the EL light appears brighter than when the conventional absorption-type polarizing plate was used.

Industrial Applicability

As described in the foregoing, the electronic device relating to the present invention is suited for implementing various types of displays, such as for watches, hand-held instruments, and so forth.

What is claimed is:

1. An electronic device comprising information generating means for generating information, a display apparatus, display driving means for outputting driving signals for display to said display apparatus on the basis of information from said information generating means, wherein said display apparatus comprises a multi-layer display panel, and when information display is performed on one arbitrary display panel layer among said multi-layer display panel, said display driving means clears all segments of other display panel layers, and wherein a state transition controlling means is provided for controlling said multi-layer display panel to indicate a content of a next display state at a time of display transitions of said display apparatus.

2. An electronic device according to claim 1 wherein said information generating mean comprises reference signal generating means, and means for generating information on the basis of reference signal from said reference signal generating means, said display apparatus comprises a multi-layer display panel, and all or part of at least one layer of said multi-layer display panel has a dot-matrix format, said display driving means having a dot-matrix controller for controlling the display of a dot-matix display panel.

3. An electronic device according to claim 2 wherein said multi-layer display panel has a quadrilateral display screen, of which only the central area is a dot-matrix display.

4. An electronic device according to claim 1 or 2 wherein said display apparatus is constructed by multi-layer liquid crystal cells.

5. An electronic device according to claim 4 wherein a reflecting-type polarizing plate is used for at least one liquid crystal cell of said display apparatus.

6. An electronic device according to claim 5 wherein said display apparatus is a multi-layer liquid crystal display panel comprising a plurality of overlapping liquid crystal cells, the lowest layer liquid crystal display cell having a reflecting-type polarizing plate opposing a backface member.

7. An electronic device according to claim 6 wherein said display apparatus has disposed a plurality of overlapping liquid crystal cells, and a light diffusion layer between said backface member disposed on the lowest layer side of said multi-layer liquid crystal display panel and said lowest layer liquid crystal display cell.

8. An electronic device according to claim 6 wherein a surface of said backface member is colored.

9. An electronic device according to claim 6 wherein said backface member is either a reflecting plate or an EL plate.

10. An electronic device according to claim 6 wherein, except for a reflecting-type polarizing plate of said lowest layer liquid crystal cell, at least one of the other polarizing plates is a reflecting-type polarizing plate.

11. An electronic device according to claim 10 wherein, said multi-layer liquid crystal display panel comprises two layers of liquid crystal cells, and three polarizing plates, with the uppermost polarizing plate an absorption-type polarizing plate and the middle layer polarizing plate a reflecting-type polarizing plate.

12. An electronic device according to claim 11 wherein said middle layer reflecting-type polarizing plate is affixed to an upper layer liquid crystal cell and separated from a lower layer liquid crystal cell.

13. An electronic device according to claim 11 wherein a display on said liquid crystal panel is in a reflecting state when no voltage is applied to said uppermost layer liquid crystal cell.

14. An electronic device according to claim 11 wherein a display on said liquid crystal panel is in a reflecting state when a voltage is applied to said uppermost layer liquid crystal cell.

* * * * *